US007414499B2

(12) United States Patent
Germain

(10) Patent No.: US 7,414,499 B2
(45) Date of Patent: Aug. 19, 2008

(54) CIRCUIT INTERRUPTING DEVICE WITH A SINGLE TEST-RESET BUTTON

(75) Inventor: Frantz Germain, Rosedale, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 239 days.

(21) Appl. No.: 11/101,313

(22) Filed: Apr. 7, 2005

(65) Prior Publication Data

US 2005/0286183 A1 Dec. 29, 2005

Related U.S. Application Data

(60) Provisional application No. 60/560,446, filed on Apr. 8, 2004.

(51) Int. Cl.
*H01H 73/00* (2006.01)
*H01H 73/12* (2006.01)
*H01H 75/00* (2006.01)

(52) U.S. Cl. ..... 335/18; 361/142

(58) Field of Classification Search ..... 335/18; 361/142

See application file for complete search history.

(56) References Cited

U.S. PATENT DOCUMENTS 2,540,496 A 2/1951 Sperrazza
2,826,652 A 3/1958 Piplack
2,926,327 A 2/1960 Metelti
3,042,840 A 7/1962 Eadie, Jr.
3,222,631 A 12/1965 Cohen
3,238,492 A 3/1966 Houston
3,309,571 A 3/1967 Gilker
3,538,477 A 11/1970 Walters et al.
3,617,662 A 11/1971 Miller
3,702,418 A 11/1972 Obenhaus
3,766,434 A 10/1973 Sherman
3,775,726 A 11/1973 Gress
3,813,579 A 5/1974 Doyle et al.

(Continued)

FOREIGN PATENT DOCUMENTS

DE 2821138 11/1978

(Continued)

OTHER PUBLICATIONS

Civil Action No. CIV-05-0301-JB/DJS, Defendant Central Purchasing LLC'S and Harbor Freight Tools USA, Inc.'s Answer and Counterclaims to Plaintiff's Second Amended Complaint, Oct. 12, 2005.

(Continued)

*Primary Examiner*—Elvin Enad
*Assistant Examiner*—Bernard Rojas
(74) *Attorney, Agent, or Firm*—Paul J. Sutton

(57) ABSTRACT

A ground fault circuit interrupter device having a single actuator for sequentially activating a circuit interrupting portion when the device is in a reset condition and a reset portion when the device is in a tripped condition. The circuit interrupting portion breaks a conductive path between a line terminal and load terminal upon the occurrence of a predetermined condition thereby placing the device in the tripped condition and the reset portion reestablishes the conductive path between the line terminal and the load terminal thereby placing the device in the reset condition.

28 Claims, 12 Drawing Sheets

U.S. PATENT DOCUMENTS

| | | | | |
|---|---|---|---|---|
| 3,864,649 | A | | 2/1975 | Doyle et al. |
| 3,872,354 | A | | 3/1975 | Nestor et al. |
| 3,949,336 | A | | 4/1976 | Dietz |
| 3,986,763 | A | | 10/1976 | Sparrow |
| 3,990,758 | A | | 11/1976 | Petterson |
| 4,002,951 | A | | 1/1977 | Halbeck |
| 4,010,431 | A | | 3/1977 | Virani et al. |
| 4,010,432 | A | | 3/1977 | Klein |
| 4,013,929 | A | | 3/1977 | Dietz et al. |
| 4,034,266 | A | | 7/1977 | Virani et al. |
| 4,034,360 | A | | 7/1977 | Schweitzer, Jr. |
| 4,051,544 | A | | 9/1977 | Vibert |
| 4,063,299 | A | | 12/1977 | Munroe |
| 4,072,382 | A | | 2/1978 | Reschke |
| 4,109,226 | A | | 8/1978 | Bowling et al. |
| 4,114,123 | A | | 9/1978 | Grenier |
| 4,148,536 | A | | 4/1979 | Petropoulsos et al. |
| 4,159,499 | A | | 6/1979 | Bereskin |
| 4,163,882 | A | | 8/1979 | Baslow |
| 4,168,104 | A | | 9/1979 | Buschow |
| 4,194,231 | A | | 3/1980 | Klein |
| 4,223,365 | A | | 9/1980 | Moran |
| 4,271,337 | A | | 6/1981 | Barkas |
| 4,288,768 | A | | 9/1981 | Arnhold et al. |
| 4,316,230 | A | | 2/1982 | Hansen et al. |
| 4,377,837 | A | | 3/1983 | Matsko et al. |
| 4,379,607 | A | | 4/1983 | Bowden, Jr. |
| 4,386,338 | A | | 5/1983 | Doyle et al. |
| 4,409,574 | A | * | 10/1983 | Misencik et al. ..... 335/18 |
| 4,412,193 | A | | 10/1983 | Bienwald et al. |
| 4,442,470 | A | | 4/1984 | Misencik |
| 4,515,945 | A | | 5/1985 | Ranken et al. |
| 4,518,945 | A | | 5/1985 | Doyle et al. |
| 4,521,824 | A | | 6/1985 | Morris et al. |
| 4,538,040 | A | | 8/1985 | Ronemus et al. |
| 4,544,219 | A | | 10/1985 | Barkas |
| 4,567,456 | A | | 1/1986 | Legatti |
| 4,568,899 | A | | 2/1986 | May et al. |
| 4,574,260 | A | | 3/1986 | Franks |
| 4,578,732 | A | | 3/1986 | Draper et al. |
| 4,587,588 | A | | 5/1986 | Goldstein |
| 4,595,894 | A | | 6/1986 | Doyle et al. |
| 4,603,932 | A | | 8/1986 | Heverly |
| 4,630,015 | A | | 12/1986 | Gernhardt et al. |
| 4,631,624 | A | | 12/1986 | Dvorak et al. |
| 4,641,216 | A | | 2/1987 | Morris et al. |
| 4,641,217 | A | | 2/1987 | Morris et al. |
| 4,686,600 | A | | 8/1987 | Morris et al. |
| 4,714,858 | A | | 12/1987 | Sanders |
| 4,719,437 | A | | 1/1988 | Yun |
| 4,722,693 | A | | 2/1988 | Rose |
| 4,802,052 | A | | 1/1989 | Brant et al. |
| 4,814,641 | A | | 3/1989 | Dufresne |
| 4,816,957 | A | | 3/1989 | Irwin |
| 4,851,951 | A | | 7/1989 | Foster, Jr. |
| 4,867,693 | A | | 9/1989 | Gizienski et al. |
| 4,867,694 | A | | 9/1989 | Short |
| 4,897,049 | A | | 1/1990 | Miller et al. |
| 4,901,183 | A | | 2/1990 | Lee |
| 4,936,789 | A | | 6/1990 | Ugalde |
| 4,949,070 | A | | 8/1990 | Wetzel |
| 4,967,308 | A | | 10/1990 | Morse |
| 4,979,070 | A | | 12/1990 | Bodkin |
| 5,006,075 | A | | 4/1991 | Bowden, Jr. |
| 5,144,516 | A | | 9/1992 | Sham |
| 5,148,344 | A | | 9/1992 | Rao et al. |
| 5,161,240 | A | | 11/1992 | Johnson |
| 5,179,491 | A | | 1/1993 | Runyan |
| 5,185,687 | A | | 2/1993 | Beihoff et al. |
| 5,202,662 | A | | 4/1993 | Bienwald et al. |
| 5,223,810 | A | | 6/1993 | Van Haaren |
| 5,224,006 | A | | 6/1993 | MacKenzie et al. |
| 5,229,730 | A | | 7/1993 | Legatti et al. |
| 5,239,438 | A | | 8/1993 | Echtler |
| 5,277,607 | A | | 1/1994 | Thumma et al. |
| 5,281,331 | A | | 1/1994 | Golan |
| 5,293,522 | A | | 3/1994 | Fello et al. |
| 5,320,545 | A | | 6/1994 | Brothers |
| 5,363,269 | A | | 11/1994 | McDonald |
| 5,374,199 | A | | 12/1994 | Chung |
| 5,418,678 | A | | 5/1995 | McDonald |
| 5,448,443 | A | | 9/1995 | Muelleman |
| 5,477,412 | A | | 12/1995 | Neiger et al. |
| 5,510,760 | A | | 4/1996 | Marcou et al. |
| 5,515,218 | A | | 5/1996 | DeHaven |
| 5,517,165 | A | | 5/1996 | Cook |
| 5,518,132 | A | | 5/1996 | Chen |
| 5,541,800 | A | | 7/1996 | Misencik |
| 5,551,884 | A | | 9/1996 | Burkhart, Sr. |
| 5,555,150 | A | | 9/1996 | Newman, Jr. |
| 5,576,580 | A | | 11/1996 | Hosoda et al. |
| 5,594,398 | A | | 1/1997 | Marcou et al. |
| 5,600,524 | A | | 2/1997 | Neiger et al. |
| 5,617,284 | A | | 4/1997 | Paradise |
| 5,625,285 | A | | 4/1997 | Virgilio |
| 5,637,000 | A | | 6/1997 | Osterbrock et al. |
| 5,654,857 | A | | 8/1997 | Gershen |
| 5,655,648 | A | | 8/1997 | Rosen et al. |
| 5,661,623 | A | | 8/1997 | McDonald et al. |
| 5,680,287 | A | | 10/1997 | Gernhardt et al. |
| 5,694,260 | A | | 12/1997 | Houston |
| 5,694,280 | A | | 12/1997 | Zhou |
| 5,702,259 | A | | 12/1997 | Lee |
| 5,706,155 | A | | 1/1998 | Neiger et al. |
| 5,710,399 | A | | 1/1998 | Castonguay et al. |
| 5,715,125 | A | | 2/1998 | Neiger et al. |
| 5,729,417 | A | | 3/1998 | Neiger et al. |
| 5,805,397 | A | | 9/1998 | MacKenzie |
| 5,825,602 | A | | 10/1998 | Tosaka et al. |
| 5,839,909 | A | | 11/1998 | Calderara |
| 5,844,765 | A | | 12/1998 | Kato et al. |
| 5,846,092 | A | | 12/1998 | Feldman et al. |
| 5,847,913 | A | | 12/1998 | Turner et al. |
| 5,875,087 | A | | 2/1999 | Spencer et al. |
| 5,877,925 | A | | 3/1999 | Singer |
| 5,902,140 | A | | 5/1999 | Cheung et al. |
| 5,915,981 | A | | 6/1999 | Mehta |
| 5,917,686 | A | | 6/1999 | Chan et al. |
| 5,920,451 | A | | 7/1999 | Fasano et al. |
| 5,933,063 | A | * | 8/1999 | Keung et al. ..... 335/18 |
| 5,943,198 | A | | 8/1999 | Hirsh et al. |
| 5,956,218 | A | | 9/1999 | Berthold |
| 5,963,408 | A | | 10/1999 | Neiger et al. |
| 6,021,034 | A | | 2/2000 | Chan et al. |
| 6,040,967 | A | | 3/2000 | DiSalvo |
| 6,052,265 | A | | 4/2000 | Zaretsky et al. |
| 6,086,391 | A | | 7/2000 | Chiu |
| 6,111,210 | A | | 8/2000 | Allison |
| 6,149,446 | A | | 11/2000 | Yu |
| 6,180,899 | B1 | | 1/2001 | Passow |
| 6,204,743 | B1 | | 3/2001 | Greenberg et al. |
| 6,217,353 | B1 | | 4/2001 | Yu-Tse |
| 6,224,401 | B1 | | 5/2001 | Yu |
| 6,226,161 | B1 | | 5/2001 | Neiger et al. |
| 6,232,857 | B1 | | 5/2001 | Mason, Jr. et al. |
| 6,238,224 | B1 | | 5/2001 | Shao |
| 6,242,993 | B1 | | 6/2001 | Fleege et al. |
| 6,246,558 | B1 | | 6/2001 | DiSalvo et al. |
| 6,252,407 | B1 | | 6/2001 | Gershen |
| 6,255,923 | B1 | | 7/2001 | Mason, Jr. et al. |
| 6,259,340 | B1 | | 7/2001 | Fuhr et al. |
| 6,282,070 | B1 | | 8/2001 | Ziegler et al. |
| 6,288,882 | B1 | | 9/2001 | DiSalvo et al. |
| 6,299,487 | B1 | | 10/2001 | Lopata et al. |

| | | | | |
|---|---|---|---|---|
| 6,309,248 | B1 | 10/2001 | King | |
| 6,381,112 | B1 | 4/2002 | DiSalvo | |
| 6,381,113 | B1 | 4/2002 | Legatti | |
| 6,422,880 | B1 | 7/2002 | Chiu | |
| 6,437,700 | B1 | 8/2002 | Herzfeld et al. | |
| 6,437,953 | B2 | 8/2002 | DiSalvo et al. | |
| D462,660 | S | 9/2002 | Huang et al. | |
| 6,525,541 | B1 | 2/2003 | Leopold | |
| 6,537,088 | B2 | 3/2003 | Huang | |
| 6,545,574 | B1 | 4/2003 | Seymour et al. | |
| 6,590,753 | B1 | 7/2003 | Finlay | |
| 6,646,838 | B2 | 11/2003 | Ziegler et al. | |
| 6,657,834 | B2 | 12/2003 | DiSalvo | |
| 6,670,870 | B2 | 12/2003 | Macbeth | |
| 6,670,872 | B2 | 12/2003 | Kurzmann | |
| 6,671,145 | B2 | 12/2003 | Germain et al. | |
| 6,749,449 | B2 | 6/2004 | Mortun | |
| 6,767,228 | B2 | 7/2004 | Katz | |
| 6,788,173 | B2 | 9/2004 | Germain et al. | |
| 6,813,126 | B2 | 11/2004 | DiSalvo et al. | |
| 6,864,766 | B2 | 3/2005 | DiSalvo et al. | |
| 6,864,769 | B2 * | 3/2005 | Germain et al. | 335/172 |
| 6,873,231 | B2 | 3/2005 | Germain | |
| 6,930,574 | B2 | 8/2005 | Gao | |
| 6,937,451 | B2 * | 8/2005 | Ulrich et al. | 361/42 |
| 6,949,994 | B2 | 9/2005 | Germain | |
| 6,958,895 | B1 | 10/2005 | Radosavljevic et al. | |
| 6,963,260 | B2 | 11/2005 | Germain | |
| 6,969,801 | B2 | 11/2005 | Radosavljevic et al. | |
| 6,975,192 | B2 * | 12/2005 | Disalvo | 335/18 |
| 7,026,895 | B2 | 4/2006 | Germain et al. | |
| 7,049,911 | B2 | 5/2006 | Germain et al. | |
| 7,088,205 | B2 | 8/2006 | Germain | |
| 7,088,206 | B2 | 8/2006 | Germain | |
| 7,161,780 | B2 | 1/2007 | Germain et al. | |
| 7,179,992 | B1 | 2/2007 | Packard et al. | |
| 7,227,435 | B2 | 6/2007 | Germain | |
| 2005/0063110 | A1 | 3/2005 | DiSalvo et al. | |
| 2006/0139132 | A1 | 6/2006 | Porter et al. | |
| 2007/0049077 | A1 | 3/2007 | Germain | |
| 2007/0111569 | A1 | 5/2007 | Germain | |
| 2007/0114053 | A1 | 5/2007 | Castaldo | |
| 2007/0211397 | A1 | 9/2007 | Sokolow | |

FOREIGN PATENT DOCUMENTS

| | | |
|---|---|---|
| DE | 3431581 C2 | 11/1991 |
| EP | 0081661 | 6/1983 |
| ES | 21345 8/77 | 5/1978 |
| FR | 2391549 | 12/1978 |
| GB | 227930 | 1/1925 |
| GB | 830018 | 9/1960 |
| GB | 2292491 | 11/1986 |
| GB | 2207823 | 8/1989 |
| JP | 61-259428 | 11/1986 |
| WO | WO0011696 | 3/2000 |
| WO | WO0045366 | 8/2000 |
| WO | WO0233720 | 4/2002 |

OTHER PUBLICATIONS

Civil Action No. CIV-05-0301-JB/DJS, Defendant Zhejiang Dongzheng Electrical Co.'s Response to Plaintiff's First Interrogatories, Feb. 3, 2006.

Civil Action No. CIV-05-0301-JB/DJS, Defendant Central Purchasing LLC's Responses to Plaintiff's First Set of Interrogatories to Defendant Central Purchasing, LLC, Feb. 13, 2006.

Civil Action No. CIV-05-0301-JB/DJS, Defendant Nicro d/b/a Nicor Lighting & Fans' Answers and Objections to Plaintiff's First Set of Interrogatories.

Practical Application Guidelines for Leakage Current Protection Devices PAG 943A, First Edition, Jan. 15, 1998, pp. 1-16.

*Shanghai Meihao Electric Inc.* v. *Leviton Mfg. Co.*, Complaint and Request for Declaratory Relief, May 6, 2005.

Civil Action No. 05-0889 AMD (Consolidated), Shanghai Meihao Electric Second Supplementary Responses to Leviton Mfg. Co., Inc. First Set of Interrogatories, Mar. 16, 2007 (Interrogatories No. 6).

Civil Action No. CIV-05-0301-JB/DJS, Defendant Central Purchasing LLC'S and Harbor Freight Tools USA, Inc.'s Answer and Counterclaims to Plaintiff's First Amended Complaint, Jun. 10, 2005.

Civil Action No. CIV-05-0301-RLP/DJS, Defendant Zhejiang Dongzheng Electrical Co.'s Answer and Counterclaims to Plaintiff's Second Amended Complaint, Oct. 12, 2005.

Civil Action No. CIV-05-0301-JB/DJS, Defendant Zehjiang Dongzheng Electrical Co.'s Answer and Counterclaims to Plaintiff's First Amended Complaint, May 27, 2005.

Civil Action No. CIV-05-0301-RLP/DJS, Defendant Zheijiang Dongzheng Electrical Co.'s Answer and Counterclaims to Plaintiff's Second Amended Complaint, Oct. 12, 2005.

Civil Action No. CIV-05-0301-RLP/DJS, Defendant Nicor, Inc.'s Answer to Plaintiff's First Amended Complaint and Counterclaim, Oct. 12, 2005.

Civil Action No. CIV-05-0301-RLP/DJS, Defendant Nicor Inc., D/B/A Nicor Lighting & Fans Answer to Plaintiff's Second Amended Complaint and Counterclaim, Oct. 12, 2005.

* cited by examiner

CIRCUIT INTERRUPTING DEVICE WITH A SINGLE TEST-RESET BUTTON

This application claims the benefit of the filing date of a provisional application having Ser. No. 60/560,446 which was filed on Apr. 8, 2004.

BACKGROUND OF THE INVENTION

1. Field of the Invention

The present application is directed to a family of resettable circuit interrupting devices and systems that comprises ground fault circuit interrupters (GFCI's), arc fault circuit interrupters (AFCI's), immersion detection circuit interrupters (IDCI's), appliance leakage circuit interrupters (ALCI's), equipment leakage circuit interrupters (ELCI's), circuit breakers, contactors, latching relays and solenoid mechanisms. More particularly, the present application is directed to circuit interrupting devices having a single actuator for breaking and making electrically conductive paths between a line side and a load side of the devices.

2. Description of the Related Art

Many electrical wiring devices have a line side, which is connectable to an electrical power supply, and a load side, which is connectable to one or more loads and at least one conductive path between the line and load sides. Electrical connections to wires supplying electrical power or wires conducting electricity to the one or more loads are at line side and load side connections. The electrical wiring device industry has witnessed an increasing call for circuit breaking devices or systems which are designed to interrupt power to various loads, such as household appliances, consumer electrical products and branch circuits. In particular, electrical codes require electrical circuits in home bathrooms and kitchens to be equipped with ground fault circuit interrupters (GFCI), for example. A more detailed description of a GFCI device is provided in U.S. Pat. No. 4,595,894, which is incorporated herein in its entirety by reference. Presently available GFCI devices, such as the device described in commonly owned U.S. Pat. No. 4,595,894 (the '894 patent), use an electrically activated trip mechanism to mechanically break an electrical connection between the line side and the load side. Such devices are resettable after they are tripped by, for example, the detection of a ground fault. In the device discussed in the '894 patent, the trip mechanism used to cause the mechanical breaking of the circuit (i.e., the conductive path between the line and load sides) includes a solenoid (or trip coil). A test button is used to test the trip mechanism and circuitry used to sense faults, and a reset button is used to reset the electrical connection between line and load sides.

However, instances may arise where an abnormal condition, caused by for example a lightning strike, occurs which may result not only in a surge of electricity at the device and a tripping of the device but also a disabling of the trip mechanism used to cause the mechanical breaking of the circuit. This may occur without the knowledge of the user. Under such circumstances an unknowing user, faced with a GFCI which has tripped, may press the reset button which, in turn, will cause the device with an inoperative trip mechanism to be reset without the ground fault protection available.

Further, an open neutral condition, which is defined in Underwriters Laboratories (UL) Standard PAG 943A, may exist with the electrical wires supplying electrical power to such GFCI devices. If an open neutral condition exists with the neutral wire on the line (versus load) side of the GFCI device, an instance may arise where a current path is created from the phase (or hot) wire supplying power to the GFCI device through the load side of the device and a person to ground. In the event that an open neutral condition exists, current GFCI devices, which have tripped, may be reset even though the open neutral condition may remain.

Commonly owned U.S. Pat. No. 6,040,967 having Ser. No. 09/138,955, which is incorporated herein in its entirety by reference, describes a family of resettable circuit interrupting devices capable of locking out the reset portion of the device if the circuit interrupting portion is non-operational or if an open neutral condition exists.

Some of the circuit interrupting devices described above have a user accessible load side connection in addition to the line and load side connections. The user accessible load side connection includes one or more connection points where a user can externally connect to the electrical power supplied from the line side. The load side connection and user accessible load side connection are typically electrically connected together. An example of such a circuit interrupting device is a GFCI receptacle, where the line and load side connections are binding screws and the user accessible load side connection is a typical two or three hole receptacle used in power outlets for connection to electrical devices typically using a three-prong or two-prong male plug. As noted, such devices are connected to external wiring so that line wires are connected to the line side connection and load side wires are connected to the load side connection.

However, instances may occur where the circuit interrupting device is improperly connected to the external wires so that the load wires are connected to the line side connection and the line wires are connected to the load connection. This is known as reverse wiring. In the event the circuit interrupting device is reverse wired, fault protection to the user accessible load connection may be eliminated, even if fault protection to the load side connection remains. Further, because fault protection is eliminated the user accessible terminals (i.e., three hole or two hole receptacles) will have electrical power making a user think that the device is operating properly when in fact it is not. Therefore, there exists a need to detect faults when the circuit interrupting device is reverse wired. Also, there exists a need to prevent a device from being reverse wired. Further, there exists a need to prevent the user accessible load terminals from having electrical power when the circuit interrupting device is reverse wired or when the circuit interrupting device is not operating properly.

Furthermore, some of the circuit interrupting devices described above include two buttons on the face of the device: a reset button and a test button. When the device is in a tripped condition, the user can depress the reset button to reestablish an electrical connection between the line and load connections, referred to as the reset state. When the device is in the reset state, the user can depress the test button to discontinue the electrical connection between the line and load connections, referred to as the tripped state.

SUMMARY OF THE INVENTION

The present invention relates to a family of resettable circuit interrupting devices having a single actuator for activating a circuit interrupting to break a conductive path between line side and load side of the device and using the same button for activating a reset portion to reestablish the conductive path. The devices prevent electric power from being accessible to users of such devices when these devices are reversed wired. The devices have a reset lockout mechanism that prevents them from being reset when they are not operating properly. When the devices are not reset and if such devices are reverse wired no power is available to any user accessible receptacles and/or plugs located on the face of the devices. Each of the devices of the present invention has at least one pair of line terminals, one pair of load terminals and one pair of face terminals. The line terminals are capable of being electrically connected to a source of power. The load terminals are capable of being electrically connected to a load and are improperly connected to electrical power when the device is reverse wired. The face terminals are electrically connected to user accessible plugs and/or receptacles located on the face of a device for example. The line, load and face terminals are electrically isolated from each other when the device is in its tripped condition. The devices of the present invention are manufactured and shipped in a trip condition, i.e., no electrical connection between line terminals and load terminals and no electrical connection between the load terminals and face terminals. Thus, in the trip condition the at least three terminals are electrically isolated from each other.

Each of the pairs of terminals has a phase terminals and a neutral terminal. A phase conducting path is created when the corresponding phase terminals are connected to each other. Similarly a neutral conducting path is created when the corresponding neutral terminals are connected to each other. Preferably, the phase conductive path includes one or more switch devices that are capable of opening to cause electrical discontinuity in the phase conductive path and capable of closing to reestablish the electrical continuity in the phase conductive paths. Also, the neutral conductive path includes one or more switch devices that are capable of opening to cause electrical discontinuity in the neutral conductive path and capable of closing to reestablish the electrical continuity in the neutral conductive paths.

The devices of the present invention each further has a pair of movable bridges which are electrically connected to the line terminals. The movable bridges electrically connect the line terminals to the load and face terminals when the devices are reset thus bringing power to the face of the devices. The movable bridges are mechanically biased away from the load and face terminals. When the devices are improperly wired or reverse wired (i.e., power connected to load terminals), the reset lockout mechanism prevents the movable bridges from connecting the line terminals to the load and face terminals even when an attempt is made to reset the device thus preventing electric power to be present at the face terminals or user accessible plugs and/or receptacles.

In one embodiment, the present application is directed to circuit interrupting devices that include a single test-reset button for triggering a reset portion and a circuit interrupting portion. The reset portion includes functionality to make electrically conductive paths between a line side and a load side of a device. The circuit interrupting portion includes functionality to break electrically conductive paths between the line side and load side. In particular, the circuit interrupting portion is an electro-mechanical mechanism that comprises a coil and plunger assembly, a latch plate and lifter assembly, a mechanical switch assembly and a mechanical trip actuator assembly. The circuit interrupting portion is capable of automatically tripping or breaking electrical connections between the load and line side upon detection of a fault or a predetermined condition. The circuit interrupting portion also can manually break electrical connections by using only the mechanical portion of the circuit interrupting portion using the test-reset button, the latch plate and lifter assembly and the mechanical trip actuator. The reset portion comprises common components as the circuit interrupting portion, particularly the same test-reset button. As a result, the operation of the device is simplified.

One embodiment for the circuit interrupting device uses an electro-mechanical circuit interrupting portion that causes electrical discontinuity between the line, load and face terminals. A reset lockout mechanism prevents the reestablishing of electrical continuity between the line, load and face terminals unless the circuit interrupting portion is operating properly. That is, the reset lockout prevents resetting of the device unless the circuit interrupting portion is operating properly. The reset portion allows the device to be reset causing electrical continuity between the line terminals and the load terminals and electrical continuity between the line terminals and the face terminals; i.e., device in reset mode. Also, there is electrical continuity between the load terminals and the face terminals when the device is reset. Thus the reset portion establishes electrical continuity between the line, load and face terminals. The electromechanical circuit interrupting portion comprises a latch plate and lifter assembly, a coil and plunger assembly, a mechanical switch assembly, the movable bridges, a mechanical trip actuator and the sensing circuit.

The reset condition is obtained by using the test-reset button. The test-reset button is mechanically biased and has a flange (e.g., circular flange or disk) that extends radially from an end portion of a pin for interference with the latch plate and lifter assembly when the test-reset button is depressed while the device is in the trip condition. The interfered latch plate and lifter assembly engages the mechanical switch assembly which triggers the sensing circuit. If the circuit interrupting portion is operating properly, the triggered sensing circuit causes a coil assembly coupled to the sensing circuitry to be energized. The energized coil assembly, which has a movable plunger located therein, causes a movable plunger to engage the latch plate to allow the end portion of the pin and the flange to go through momentarily aligned openings in the latch plate and lifter assembly. The openings then become misaligned trapping the flange and the end portion of the pin underneath the lifter. The flange is now positioned under the latch plate and lifter assembly. When the test-reset button is released after having been depressed, the biasing of the button is such that the pin tends to move away from the latch and lifter assembly. Upon release of the test-reset button, the biasing of the pin in concert with its interfering flange engages and lifts the latch plate and lifter assembly. Thus, the lifter engages the movable bridges to cause the bridges to electrically connect the line, load and face terminals to each other thus putting the device in a reset condition. If the circuit interrupting portion is not operating properly the plunger of the coil assembly does not engage the latch plate and lifter assembly thus preventing the circuit interrupting device from being reset.

The sensing circuit comprises various electrical and electronic components for detecting the occurrence of a predetermined condition. The sensing circuitry is coupled to the electromechanical circuit interrupting portion. Upon detection of a predetermined condition the sensing circuitry activates the electromechanical circuit interrupter causing the device to be in the trip condition.

The trip condition can be obtained by activating the circuit interrupting portion by depressing the test-reset button when the device is in the reset state. The trip condition can also occur when the device detects a predetermined condition (e.g., ground fault) while in the reset mode. In one embodiment, when the test-reset button is depressed, while the device is in the reset mode, the test-reset button engages the mechanical trip actuator causing a cam action between the pin and the trip actuator resulting in the momentary alignment of the lifter and latch plate openings; this allows the end portion and flange of the pin to be released from underneath the lifter and thus no longer interfere with the lifter and latch plate assembly. As a result the lifter and latch plate no longer lift the movable bridges and the biasing of the movable bridges causes them to move away from the load and face terminals to disconnect the line, load and face terminals from each other thus putting the device in the trip condition.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features and advantages of the present invention will become more fully apparent from the following detailed description, the appended claim, and the accompanying drawings in which similar elements are given similar reference numerals:

DETAILED DESCRIPTION

Figure 1:
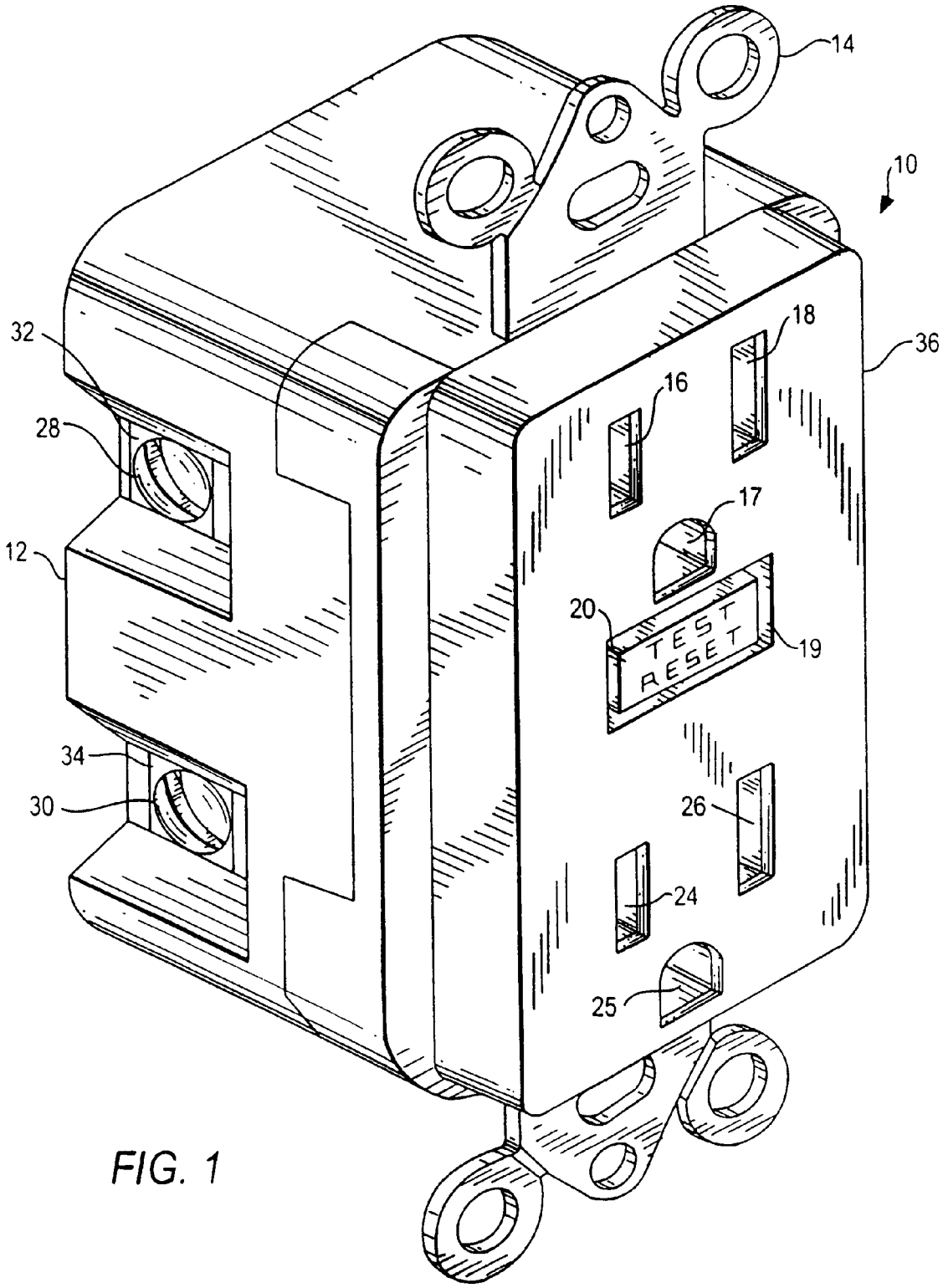
FIG. 1 is a perspective view of one embodiment of a ground fault circuit interrupting device according to the present application.

The present application contemplates various types of circuit interrupting devices that have at least one conductive path. The conductive path is typically divided between a line side that connects to electrical power, a load side that connects to one or more loads and a user side that connects to user accessible plugs or receptacles. As noted, the various devices in the family of resettable circuit interrupting devices comprise: ground fault circuit interrupters (GFCI's), arc fault circuit interrupters (AFCI's), immersion detection circuit interrupters (IDCI's), appliance leakage circuit interrupters (ALCI's) and equipment leakage circuit interrupters (ELCI's).

For the purpose of the present application, the structure or mechanisms used in the circuit interrupting devices, shown in the drawings and described hereinbelow, are incorporated into a GFCI device suitable for installation in a single-gang junction box used in, for example, a residential electrical wiring system. However, the mechanisms according to the present application can be included in any of the various devices in the family of resettable circuit interrupting devices. Further, more generally the circuit interrupting device of the present invention can be implemented as any device having at least a first, second, and third electrical conductor each of which is at least partially disposed in a housing. The electrical conductors are electrically isolated from each other with the first conductor capable of being connected to electrical power, the second conductor capable of being connected to one or more loads and the third conductor configured to be accessible to users. At least one movable bridge, one end of which is connected to the source of power and the first conductor, is able to connect the first, second and third electrical conductors to each other and disconnect said conductors from each other when a fault or predetermined condition is detected.

More specifically, however, the circuit interrupting devices described herein have at least three pairs of electrically isolated terminals: at least one pair of line terminals, at least one pair of load terminals and at least one pair of user or face terminals. The at least one pair of line terminals permits electrical power (e.g., alternating current (AC)) to be connected to the device and the at least one pair of load terminals permits external conductors or appliances to be connected to the device. These connections may be, for example, electrical fastening devices that secure or connect external conductors to the circuit interrupting device, as well as conduct electricity. Examples of such connections include binding screws, lugs, terminals and external plug connections. The at least one face or user terminal, which typically is implemented using two-prong or three-prong receptacles, allows users to electrically connect electrical devices to the GFCI device typically via the two-prong or three-prong male plugs that mate with the receptacles.

The above-described features can be incorporated in any resettable circuit interrupting device, but for the sake of explanation the description to follow is directed to a GFCI device.

In one embodiment, the GFCI device having a single test-reset actuator for activating a circuit interrupting or test portion to break a conductive path between line side and load side of the device and for activating a reset portion to reestablish the conductive path. The reset portion includes functionality to make electrically conductive paths between a line side and a load side of a device. The circuit interrupting portion includes functionality to break electrically conductive paths between the line side and load side. In particular, the circuit interrupting portion includes an electro-mechanical mechanism comprising a coil and plunger assembly, a latch plate and lifter assembly, a mechanical switch assembly and a mechanical trip actuator. The circuit interrupting portion is capable of automatically tripping or breaking electrical connections between the load and line side upon detection of a fault or a predetermined condition. The circuit interrupting portion also can manually break electrical connections by using only the mechanical portion of the circuit interrupting portion comprising the latch plate and lifter assembly and the mechanical trip actuator. The reset portion comprises the same components as the circuit interrupting portion, particularly the same test-reset button.

In another embodiment, the GFCI device has a circuit interrupting portion, a reset portion and a reset lockout mechanism. The GFCI device further has a pair of movable bridges that, when engaged, connect the line terminals to load and face terminals. When the bridge is not engaged, the line, load and face terminals are electrically isolated from each other. Because the face terminals are electrically isolated from the load and line terminals, there will be no power at the face terminals even if the GFCI device is reverse wired (power connected to load terminals instead of line terminals). When the movable bridge is not engaged and thus the line, load and face terminals are electrically isolated from each other, the device is said to be in a tripped condition.

The circuit interrupting and reset portions described herein preferably use electro-mechanical components to break (open) and make (close) one or more conductive paths between the line and load terminals of the device and also between the line and face terminals. However, electrical components, such as solid state switches and supporting circuitry, may be used to open and close the conductive paths.

Generally, the circuit interrupting portion is used to automatically break electrical continuity in one or more conductive paths (i.e., open the conductive path) between the line and load terminals upon the detection of a fault, which in the embodiment described is a ground fault. Electrical continuity is also broken between the line and face terminals. The reset portion is used to close the open conductive paths.

In this configuration, the operation of the reset and reset lockout portions is in conjunction with the operation of the circuit interrupting portion, so that electrical continuity in open conductive paths cannot be reset if the circuit interrupting portion is non-operational, if an open neutral condition exists and/or if the device is reverse wired. When the circuit interrupting portion is non-operational—meaning that any one or more of its components is not operating properly—the device cannot be reset. The test-reset button is able to break electrical continuity between the line, load and face terminals independently of the operation of the circuit interrupting portion. Thus, in the event the circuit interrupting portion is not operating properly, the device can still be tripped.

Turning now to FIG. 1, the GFCI device 10 has a housing 12 to which a face or cover portion 36 is removably secured. The face portion 36 has entry ports 16, 18, 24 and 26 aligned with receptacles for receiving normal or polarized prongs of a male plug of the type normally found at the end of a household device electrical cord (not shown), as well as ground-prong-receiving openings 17 and 25 to accommodate three-wire plugs. The GFCI device also includes a mounting strap 14 used to fasten the device to a junction box. A single actuator embodied as a test-reset button 20 forming a part of the reset portion extends through opening 19 in the face portion 36 of the housing 12. The test-reset button 20 alternately activates both a test operation (tripped condition) and reset operation (reset operation), hence it is a dual function button. The test-reset button 20 can be used to activate a reset operation, which reestablishes electrical continuity in the open conductive paths. The test-reset button 20 also can used to establish a trip condition by activating the circuit interrupting portion of the device. The circuit interrupting portion, to be described in more detail below, is used to break electrical continuity in one or more conductive paths between the line and load side of the device.

Still referring to FIG. 1, electrical connections to existing household electrical wiring are made via binding screws 28 and 30 where, for example, screw 30 is an input (or line) phase connection, and screw 28 is an output (or load) phase connection. Screws 28 and 30 are fastened (via a threaded arrangement) to terminals 32 and 34 respectively. However, the GFCI device can be designed so that screw 30 can be an output phase connection and screw 28 an input phase or line connection. Terminals 32 and 34 are one half of terminal pairs. Thus, two additional binding screws and terminals (not shown) are located on the opposite side of the device 10. These additional binding screws provide line and load neutral connections, respectively. It should also be noted that the binding screws and terminals are exemplary of the types of wiring terminals that can be used to provide the electrical connections. Examples of other types of wiring terminals include set screws, pressure clamps, pressure plates, push-in type connections, pigtails and quick-connect tabs. The face terminals are implemented as receptacles configured to mate with male plugs. A detailed depiction of the face terminals is shown in FIG. 2.

Figure 2:
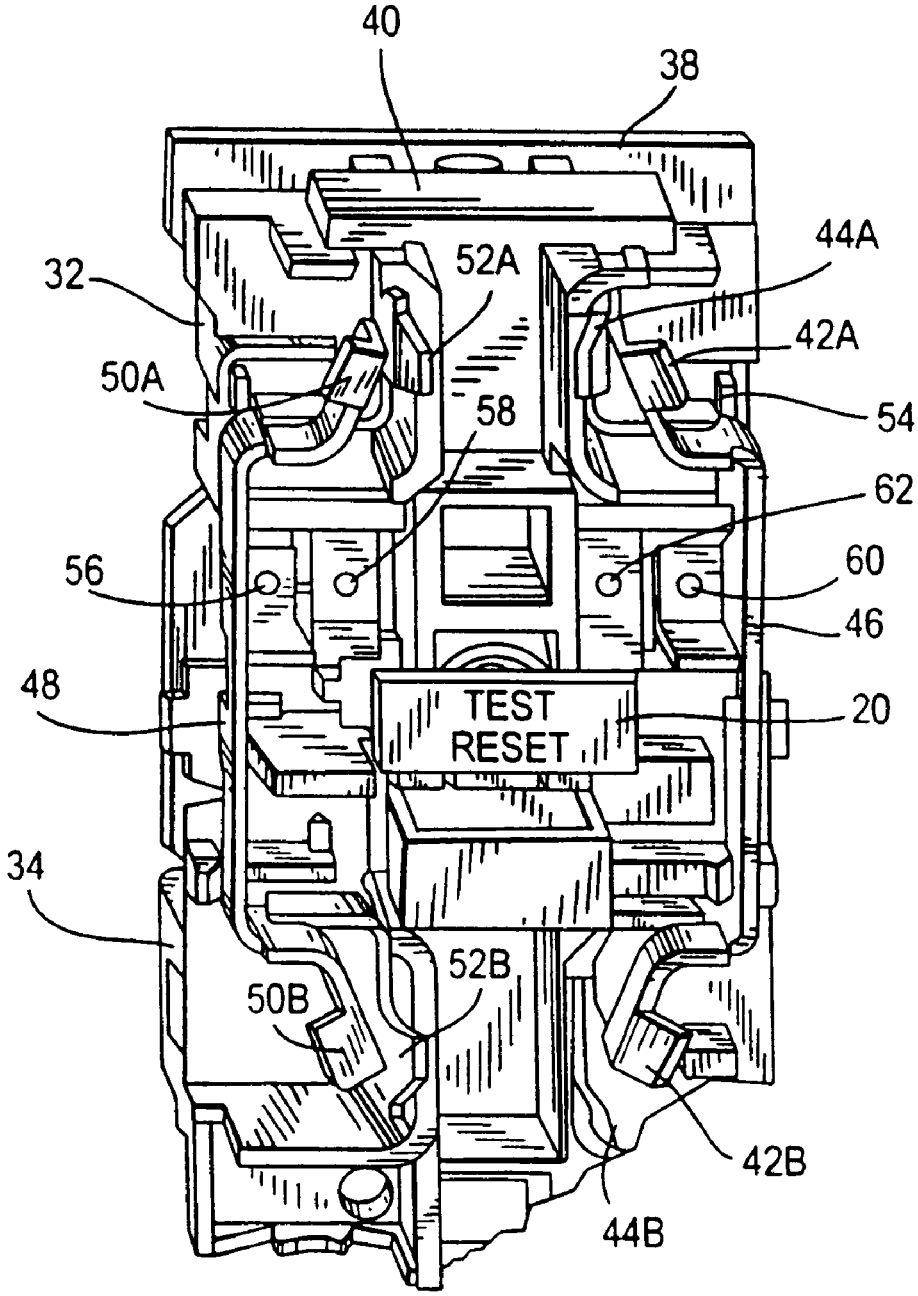
FIG. 2 is top view of a portion of the GFCI device shown in FIG. 1, with the face portion removed.

Referring to FIG. 2, a top view of the GFCI device (without face portion 36 and strap 14) is shown. An internal housing structure 40 provides the platform on which the components of the GFCI device are positioned. Test-reset button 20 is mounted on housing structure 40. Housing structure 40 is mounted on printed circuit board 38. The receptacle aligned to opening 16 of face portion 36 is made from extensions 50A and 52A of frame 48. Frame 48 is made from an electricity conducting material from which the receptacles aligned with openings 16 and 24 are formed. The receptacle aligned with opening 24 of face portion 36 is constructed from extensions 50B and 52B of frame 48. Also, frame 48 has a flange the end of which has electricity conducting contact 56 attached thereto. Frame 46 is an electricity conducting material from which receptacles aligned with openings 18 and 26 are formed. The receptacle aligned with opening 18 of frame portion 36 is constructed with frame extensions 42A and 44A. The receptacle aligned with opening 26 of face portion 36 is constructed with extensions 42B and 44B. Frame 46 has a flange the end of which has electricity conducting contact 60 attached thereto. Therefore, frames 46 and 48 form the face terminals implemented as receptacles aligned to openings 16, 18, 24 and 26 of face portion 36 of GFCI 10 (see FIG. 1). Load terminal 32 and line terminal 34 are also mounted on internal housing structure 40. Load terminal 32 has an extension the end of which electricity conducting load contact 58 is attached. Similarly, load terminal 54 has an extension to which electricity conducting contact 62 is attached. The line, load and face terminals are electrically isolated from each other and are electrically connected to each other by a pair of movable bridges. The relationship between the line, load and face terminals and how they are connected to each other is shown in FIG. 3.

Figure 3:
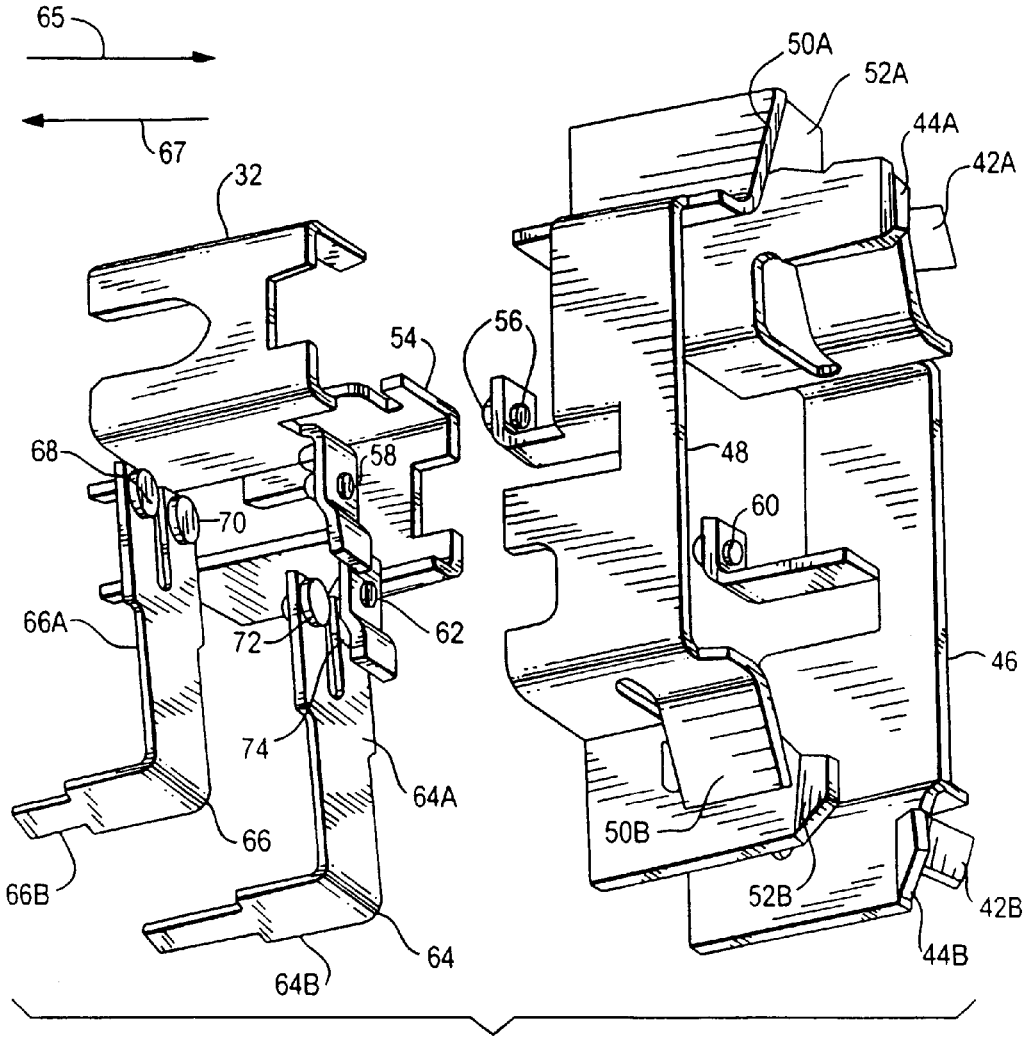
FIG. 3 is an exploded perspective view of the face terminal internal frames, the load terminals and the movable bridges.

Referring now to FIG. 3, there is shown the positioning of the face and load terminals with respect to each other and their interaction with the movable bridges (64, 66). Although the line terminals are not shown, it is understood that they are electrically connected to one end of the movable bridges. The movable bridges (64, 66) are generally electrical conductors that are configured and positioned to connect at least the line terminals to the load terminals. In particular movable bridge 66 has bent portion 66B and connecting portion 66A. Bent portion 66B is electrically connected to line terminal 34 (not shown). Similarly, movable bridge 64 has bent portion 64B and connecting portion 64A. Bent portion 64B is electrically connected to the other line terminal (not shown); the other line terminal being located on the side opposite that of line terminal 34. Connecting portion 66A of movable bridge 66 has two fingers each having a bridge contact (68, 70) attached to its end. Connecting portion 64A of movable bridge 64 also has two fingers each of which has a bridge contact (72, 74) attached to its end. The bridge contacts (68, 70, 72 and 74) are made from relatively highly conductive material. Also, face terminal contacts 56 and 60 are made from relatively highly conductive material. Further, the load terminal contacts 58 and 62 are made from relatively highly conductive material. The movable bridges are preferably made from flexible metal that can be bent when subjected to mechanical forces. The connecting portions (64A, 66A) of the movable bridges are mechanically biased downward or in the general direction shown by arrow 67. When the GFCI device is reset the connecting portions of the movable bridges are caused to move in the direction shown by arrow 65 and engage the load and face terminals thus connecting the line, load and face terminals to each other. In particular connecting portion 66A of movable bridge 66 is bent upward (direction shown by arrow 65) to allow contacts 68 and 70 to engage contacts 56 of frame 48 and contact 58 of load terminal 32 respectively. Similarly, connecting portion 64A of movable bridge 64 is bent upward (direction shown by arrow 65) to allow contacts 72 and 74 to engage contact 62 of load terminal 54 and contact 60 of frame 46 respectively. The connecting portions of the movable bridges are bent upwards by a latch/lifter assembly positioned underneath the connecting portions where this assembly moves in an upward direction (direction shown by arrow 65) when the GFCI is reset as will be discussed herein below. It should be noted that the contacts of a movable bridge engaging a contact of a load or face terminals occurs when electric current flows between the contacts; this is done by having the contacts touch each other. Some of the components that cause the connecting portions of the movable bridges to move upward are shown in FIG. 4.

Figure 4:
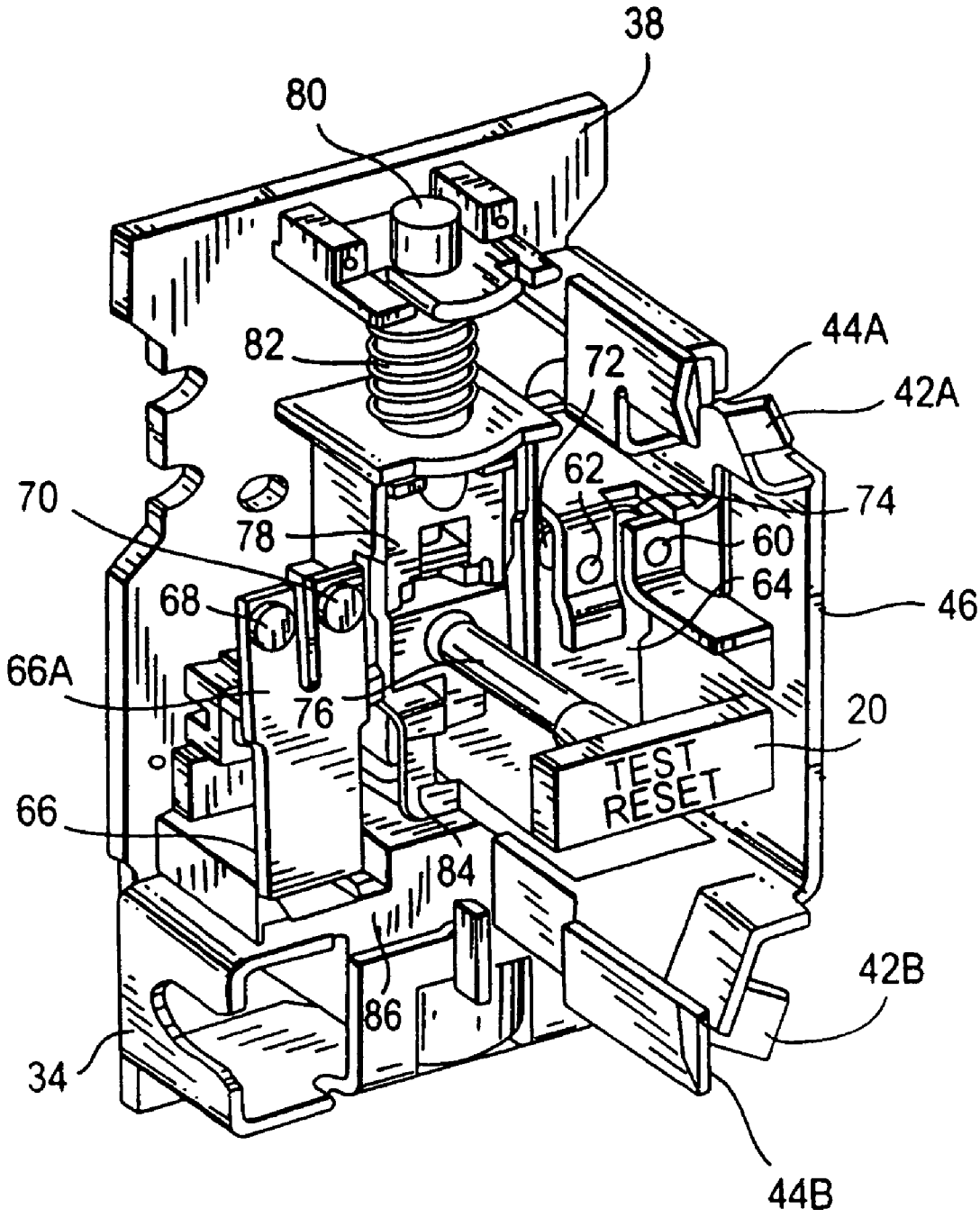
FIG. 4 is a perspective view of the arrangement of some of the components of the circuit resetting and interrupting portion of the device of the present invention.

Referring now to FIG. 4, there is shown mounted on printed circuit board 38 a coil plunger combination comprising bobbin 82 having a cavity in which elongated cylindrical plunger 80 is slidably disposed. For clarity of illustration frame 48 and load terminal 32 are not shown. One end of plunger 80 is shown extending outside of the bobbin cavity. A spring is coupled to the plunger to provide a proper force for pushing a portion of the plunger outside of the bobbin cavity after the plunger has been pulled into the cavity due to a resulting magnetic force when the coil is energized. Electrical wire (not shown) is wound around bobbin 82 to form the coil. For clarity of illustration the wire wound around bobbin 82 is not shown. Hereinafter, the bobbin 82 will be referred to as the coil 82 for ease of explanation. A lifter 78 and latch 84 assembly is shown where the lifter 78 is positioned underneath the movable bridges. The movable bridges 66 and 64 are secured with mounting brackets 86 (only one is shown) which is also used to secure line terminal 34 and the other line terminal (not shown) to the GFCI device. It is understood that the other mounting bracket 86 used to secure movable bridge 64 is positioned directly opposite the shown mounting bracket. The test-reset button 20 is part of a pin 76 that engages lifter 78 and latch 84 assembly and a mechanical trip actuator as will be shown below.

Figure 5:
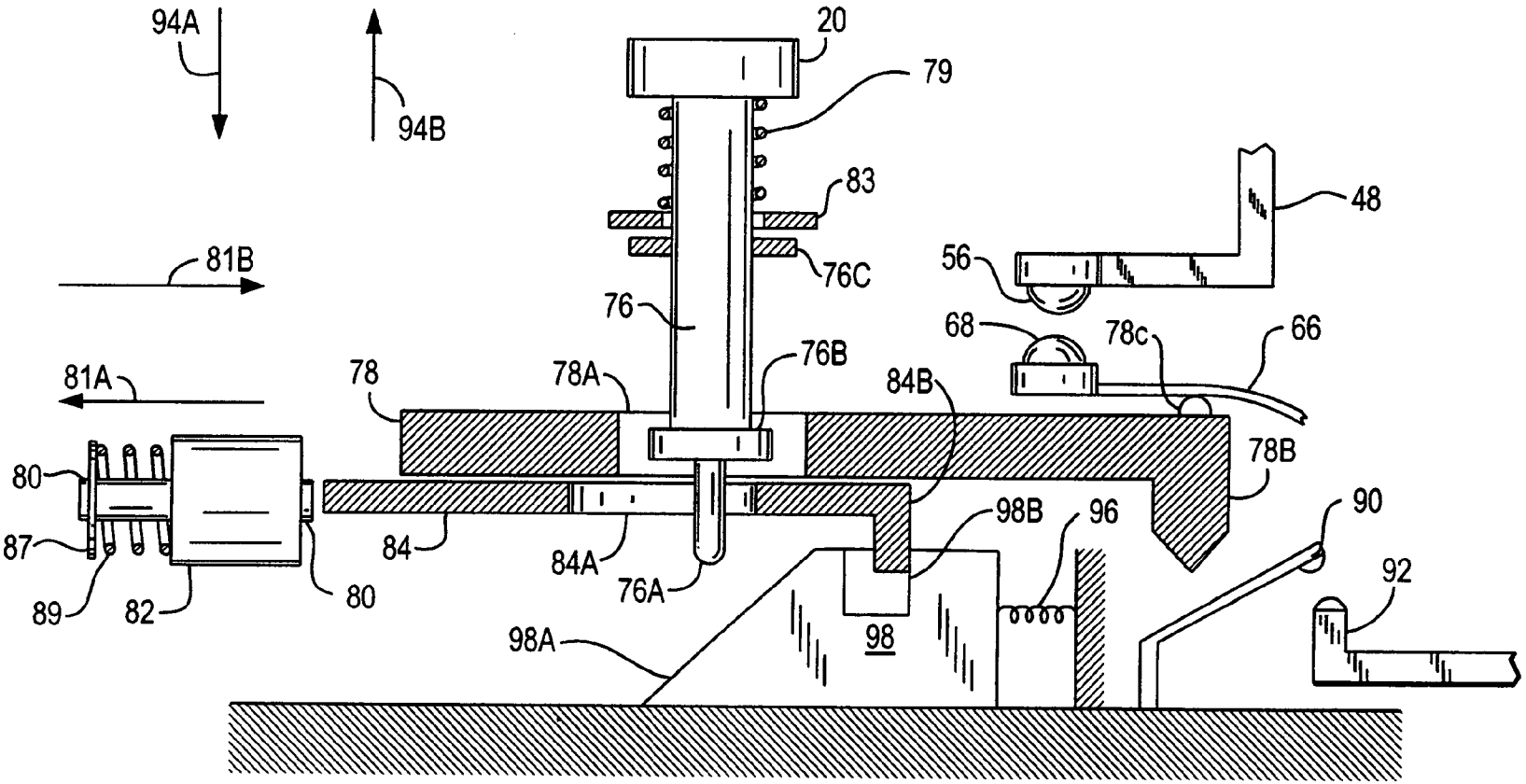
FIG. 5 is a simplified side view of FIG. 4.

Referring now to FIG. 5, there is shown a partial side view of FIG. 4. The device is shown in the tripped condition such that contact 68 of bridge 66 is not in electrical contact with contact 56 of frame 48. Similarly, contact 70 (FIG. 3) of bridge 66 is not in electrical contact with contact 58 of load terminal 54. In addition, contacts 72, 74 (FIG. 3) of bridge 64 are not in contact with respective contact 62 of load terminal 54 and contact 60 of frame 46.

FIG. 5 shows the positioning of the lifter 78 and the latch plate 84 relative to the plunger 80. One end of the plunger 80 has a flange 87 to hold a spring 89 for biasing the plunger away (in the direction shown by arrow 81A) from the latch plate 84 when the coil 82 is not energized as shown. The plunger 80 is aligned with the vertical side of the latch plate 84 and is pulled by the coil in the direction shown by arrow 81B to momentarily contact the vertical side of the latch 84 when the coil is energized as during the reset condition. The upper end of the pin 76 is connected to the test-reset button 20 and the lower end of the pin has a pin portion 76A. A flange 76B having a disk or ring shape is located between the lower pin portion 76A and the button 20. The lower pin portion 76A and the flange 76B are positioned so as to extend through aligned openings 84A and 78A of the latch 84 and lifter 78 respectively when aligned. The openings 84A, 78A are shown misaligned so the flange 76B is not able to extend through opening 84A. The test-reset button 20 and pin 76 are biased in the upward direction (shown by arrow 94B) by a pin spring 79 which is held in place by a stop element 83 and a portion of the button. The pin 76 is slidably coupled to the stop element 83 which is fixed in place. The pin 76 has a stop flange 76C located below the stop element 83 to prevent the pin 76 from moving upward and beyond the stop element 83. When the test-reset button 20 is pressed downward (in the direction shown by arrow 94A), the bias from spring 79 will cause the button 20 to return its original position by moving in the direction shown by arrow 94B when the button 20 is released.

The latch plate 84 is slidably mounted to lifter 78 such that the plate slides in the horizontal directions shown by arrows 81A, 81B relative to the lifter 78 but the lifter is fixed in the horizontal direction. The latch plate 84 and the lifter 78 are bound together in the vertical direction and thus are capable of moving together in concert in the vertical direction shown by the arrows 94A, 94B. The mechanical switch assembly comprises a flexible test arm 90 and test pin/conductor 92 which are used to cause a trip condition to occur. The test arm 90 is mechanically biased upward in the direction shown by arrow 94B. Projecting downward at one end of the lifter 78 is a cone shaped protrusion 78B which is positioned over the test arm 90.

When the test-reset button 20 is pressed downward (in the direction as shown by arrow 94A), as during a reset condition described in detail below, the pin flange 76B interferes with the latch 84 causing it to move downward. Because the latch 84 and the lifter 78 are bound together in the vertical direction, they move downward in concert causing the protrusion 78B to move downward making contact with the flexible end of the test arm 90. As described in detail below, when the button 20 is released, the pin flange 76B is caught underneath the latch 84 causing it and the lifter 78 to move upward (direction shown by arrow 94B) allowing the test arm 90 to flex upward back to its original position. The top side of the lifter 78 has a protrusion 78C positioned under the curved flexible portion of the bridge 66 to make contact with it. For example, during a reset condition, the latch 84 and the lifter 78 move upward causing the lifter protrusion 78C to also move upward and make contact with the curved flexible portion of the bridge 66. This causes contact 68 to move upward and make electrical contact with contact 56. During the tripped condition as described in detail below, the lifter 78 and the protrusion 78C move downward (in the direction shown by arrow 94A) causing the curved flexible portion of the bridge 66 to move away from frame 48 resulting in the electrical disconnection of contact 68 and contact 56.

A mechanical trip actuator 98 is a block shaped element having one vertical side surface coupled to a coil spring 96 and the opposite side surface with a cam portion 98A. The coil spring 96 urges the actuator to move in the direction shown by arrow 81A. The actuator 98 has a notch 98B for coupling with a latch protrusion 84B located at one end of the latch. The depth of the notch 98B is such that the protrusion 84B can move or slide within the notch in the vertical direction as shown in arrows 94A, 94B. The width of the notch 98B is larger than the width of the protrusion 84B such that the protrusion can move or slide within the notch in the horizontal directions 81A, 81B. This feature provides a time delay between the movement of the actuator 98 and the latch plate 84. For example, during a tripped condition, the release of the pin 76 causes the actuator 98 to begin to recoil in the direction of arrow 81A but the latch 84 will not immediately move until the right vertical wall of actuator notch 98B makes contact with the latch protrusion 84B.

The cam portion 98A, which is opposite the spring, cooperates with pin portion 76A to provide a cam action used during the tripped condition. The cam portion 98A can have a ramp shape so that when it engages with the end of the pin portion 76A, a cam action occurs due to the angle of the cam portion 98A. As the test-reset button 20 is pushed down (direction shown by arrow 94A), the end of the pin portion 76A contacts the cam portion 98A causing the actuator 98 to move towards the spring 96 in the direction of 81B. Because the actuator 98 is coupled to the latch plate 84, the cam action causes the latch plate 84 to also move in the direction shown by arrow 81B. This movement causes latch plate opening 84A to be aligned with the lifter opening 78A. Now, when the button 20 is released, the bias of the spring 96 causes the latch plate 84 and the actuator 98 to recoil in the opposite direction shown by arrow 81A.

The lower pin portion 76A and the flange 76B extend through opening 84A of latch plate 84 when the openings 84A, 78A are aligned to each other. The openings 84A, 78A become aligned with each other when the plunger 80 of the coil 82 of plunger assembly engages latch plate 84 as will be discussed herein. The plunger 80 is caused to contact latch plate 84 when the coil 82 is energized by a sensing circuit when the circuit detects a fault or a predetermined condition. In the embodiment being discussed, the predetermined condition detected is a ground fault. The predetermined condition can be any type of fault such as an arc fault, equipment fault, appliance leakage fault or an immersion detection fault. Generally a fault is an indication that the circuit interrupting device has detected a dangerous condition and has or intends to disconnect power from any loads connected to the device via the load terminals and/or the face terminals. The sensing circuit is shown in FIG. 6.

Figure 6:
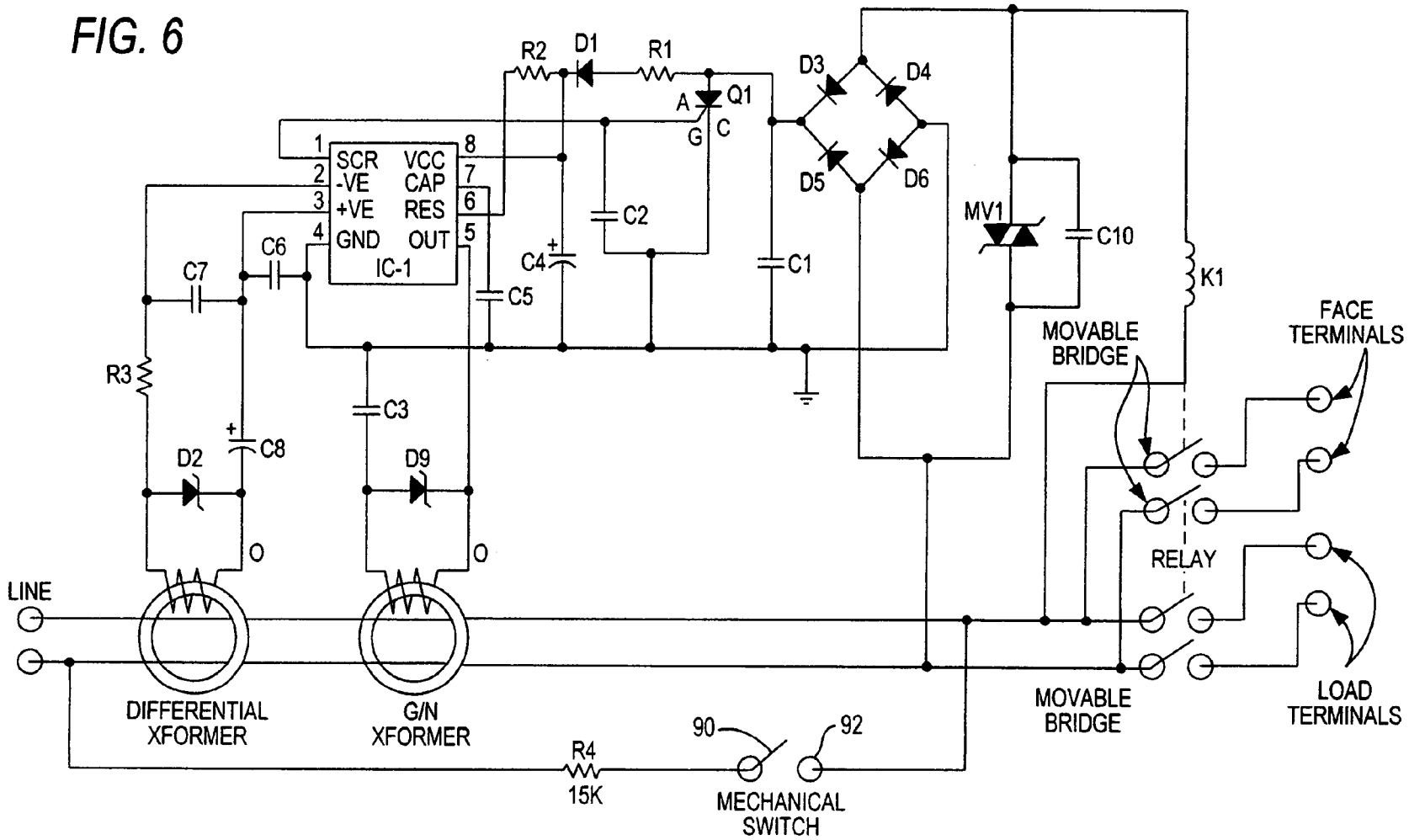
FIG. 6 is a schematic diagram of a sensing circuit of a GFCI.

Referring now to FIG. 6, there is shown a sensing circuit for detecting a predetermined condition such as a ground fault. The sensing circuit comprises a differential transformer and a ground/neutral (G/N) transformer each of which can comprise a magnetic core having a coil winding with two ends. The differential transformer is used for detecting a current imbalance on the line terminals. The G/N transformer is used for detecting a remote ground voltage that may be present on one of the load terminals. The first end of the differential transformer is connected to the input pin 2 of IC-1 through current limiting resistor R3 and the second end of the transformer is connected to input pin 3 of IC-1 through filter capacitor C8. Filter capacitor C7 is placed across pins 2 and 3 of IC-1 to filter unwanted signals. Filter capacitor C6 is placed across pins 3 and 4 of IC-1 and the system ground terminal GND for reducing unwanted signals. A zener diode D2 is placed across the two ends of the differential transformer to limit any potential overvoltage surges across the differential transformer. The first end of the G/N transformer is connected to the output pin 5 of IC-1 and the second end of the G/N transformer is connected to the system ground terminal through a filter capacitor C3 for filtering unwanted signals. A zener diode D9 is placed across the first and second ends of G/N transformer to limit any potential overvoltage surges across the transformer.

Integrated circuit IC-1 can be one of the integrated circuits typically used in ground fault circuits, for example LM-1851, manufactured by National Semiconductor or other well known semiconductor manufacturers. IC-1 has an output pin 1 connected to the gate terminal of a semiconductor switch device Q1 for trigging the switch in response to a fault detection signal received by IC-1. A filter capacitor C2 is connected across pin 1 of IC-1 and the system ground terminal for reducing unwanted signals. A filter capacitor C4 is connected across the power supply terminal (pin 8) and the system ground terminal for reducing unwanted signals. A timing capacitor C5 is connected across pin 7 of IC-1 and the system ground terminal for setting the timing of IC-1. Resistor R2 is connected across pins 6 and 8 of IC-1 for setting the sensitivity of IC-1. The cathode of diode D1 is connected to the power supply terminal and the anode of the diode is connected to the anode of switch Q1 through resistor R1. Diode D1 performs a rectification function providing the power supply voltage at the power supply terminal for powering IC-1 and the other components. The cathode terminal of the switch Q1 is connected to the system ground terminal and the anode terminal is connected to the DC side of a full wave bridge comprising diodes D3-D6. A filter capacitor C1 is connected across the anode and cathode terminals of switch Q1 for reducing unwanted signals. Although the switch Q1 is shown as a silicon controlled rectifier (SCR) other semiconductor or mechanical switches can be used. A surge suppressor MV1 is coupled across the AC portion of the full wave bridge comprising diodes D3-D6 for absorbing extreme electrical energy levels that may be present at the line terminals. A filter capacitor C10 is coupled across the surge suppressor MV1 for filtering out unwanted signals.

The mechanical switch—comprising electricity conducting test arm 90 and test pin 92—is shown connected to the conductors of the line terminals in series with current limiting resistor R4. The movable bridges are shown as switches that connect the line terminals to the face and load terminals. The line, load and face terminals are electrically isolated from each other unless connected by the movable bridges. When a predetermined condition—such as a ground fault—occurs, there is a difference in current amplitude between the two line terminals. This current difference is manifested as a net current which is detected by the differential transformer and is provided to IC-1.

In response to the current provided by the differential transformer, integrated circuit IC-1 generates a voltage on pin 1 which causes switch Q1 to turn. When Q1 turns on, current flows through the switch Q1 and the full wave bridge causing the relay K1 to activate resulting in the movable bridges removing power from the face and load terminals. The relay K1 can also be activated when test arm 90 is closed which causes a current imbalance on the line terminal conductors that is detected by the differential transformer. The G/N transformer detects a remote ground voltage that may be present on one of the load terminal conductors and provides a current to IC-1 upon detection of this remote ground which again activates relay K1.

The sensing circuit engages a circuit interrupting portion of the GFCI device causing the device to be tripped. Also, the sensing circuit allows the GFCI device to be reset after it has been tripped if the reset lockout has not been activated as discussed herein below. In the tripped condition the line terminals, load terminals and face terminals are electrically isolated from each other. A GFCI manufactured in accordance to present invention is shipped in the tripped condition. Thus, if the device is reverse wired, there will be no power at the face terminals.

The circuit interrupting portion is an electromechanical mechanism that comprises the coil 82 and plunger 80 assembly, the latch plate 84 and lifter 78 assembly, the mechanical switch assembly 90, 92, and the mechanical trip actuator 98 assembly. The circuit interrupting portion is capable of automatically tripping or breaking electrical connections between the load and line side upon detection of a fault or a predetermined condition. The circuit interrupting portion also can manually break electrical connections by using only the mechanical portions of the circuit interrupting portion comprising the test-reset button 20, the latch plate 84 and lifter 78 assembly and the mechanical trip actuator 98.

Figure 7:
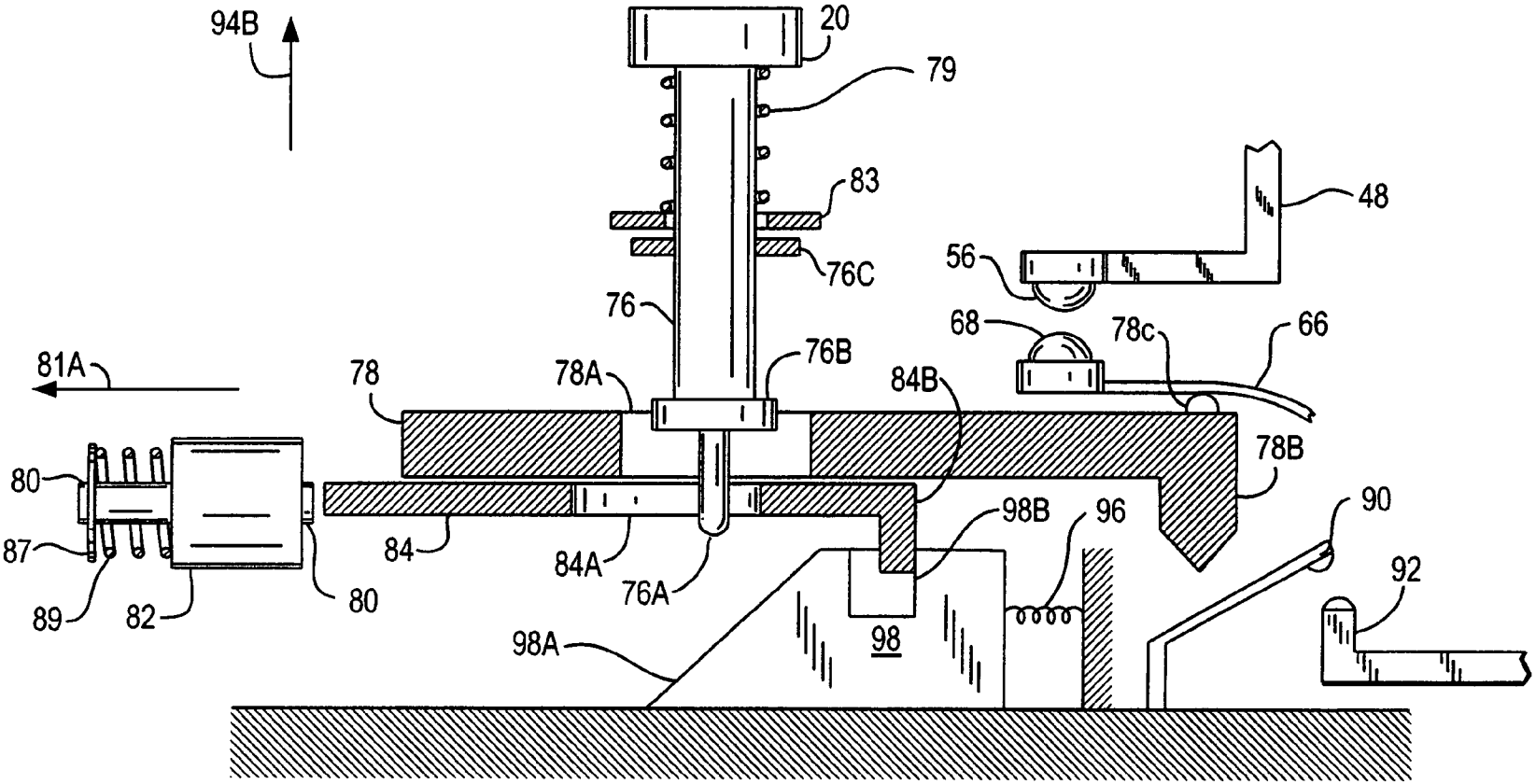
FIGS. 7-10 show the sequence of operation when the device of the present invention is reset from a tripped state.

Referring to FIGS. 7-10, there is shown a sequence of how the GFCI is reset from a tripped condition by depressing the test-reset button 20. When the GFCI device is in a tripped condition, the line, load and face terminals are electrically isolated from each other because the movable bridges are not engaged to any of the terminals. Referring to FIG. 7, contact 68 of bridge 66 is not in contact with contact 56 of frame 48. In addition, contact 70 of bridge 66 (FIG. 3) is not in contact with contact 58 of load terminal 54. Similarly, contacts 72, 74 of bridge 64 are not in contact with contact 62 of load terminal 54 and contact 60 of frame 46, respectively. Test-reset button 20 is in its fully up position (in the direction of arrow 94B) because of the upward bias of pin spring 79. Latch plate 84 and lifter 78 are positioned such that the openings 84A, 78A are misaligned not allowing pin flange 76B to go through the openings. Lifter protrusion 78B is positioned directly above test arm 90 but is not in contact with the test arm. The test arm 90 is biased in the upward direction shown by arrow 94B. The coil 82 is not energized so the plunger 80 is inside the coil 82 and is not engaged with the latch 84. The plunger 80 is normally inside the coil 82 because of the bias from spring 89 forcing the plunger in the direction shown by arrow 81A. The bias of spring 96 urges the trip actuator 98 and notch 98B in the direction shown by arrow 81A causing the latch protrusion 84B to contact the right vertical side wall of the notch 98B. The pin portion 76A is positioned over the mechanical trip actuator cam portion 98A but is not in contact with it.

Figure 8:
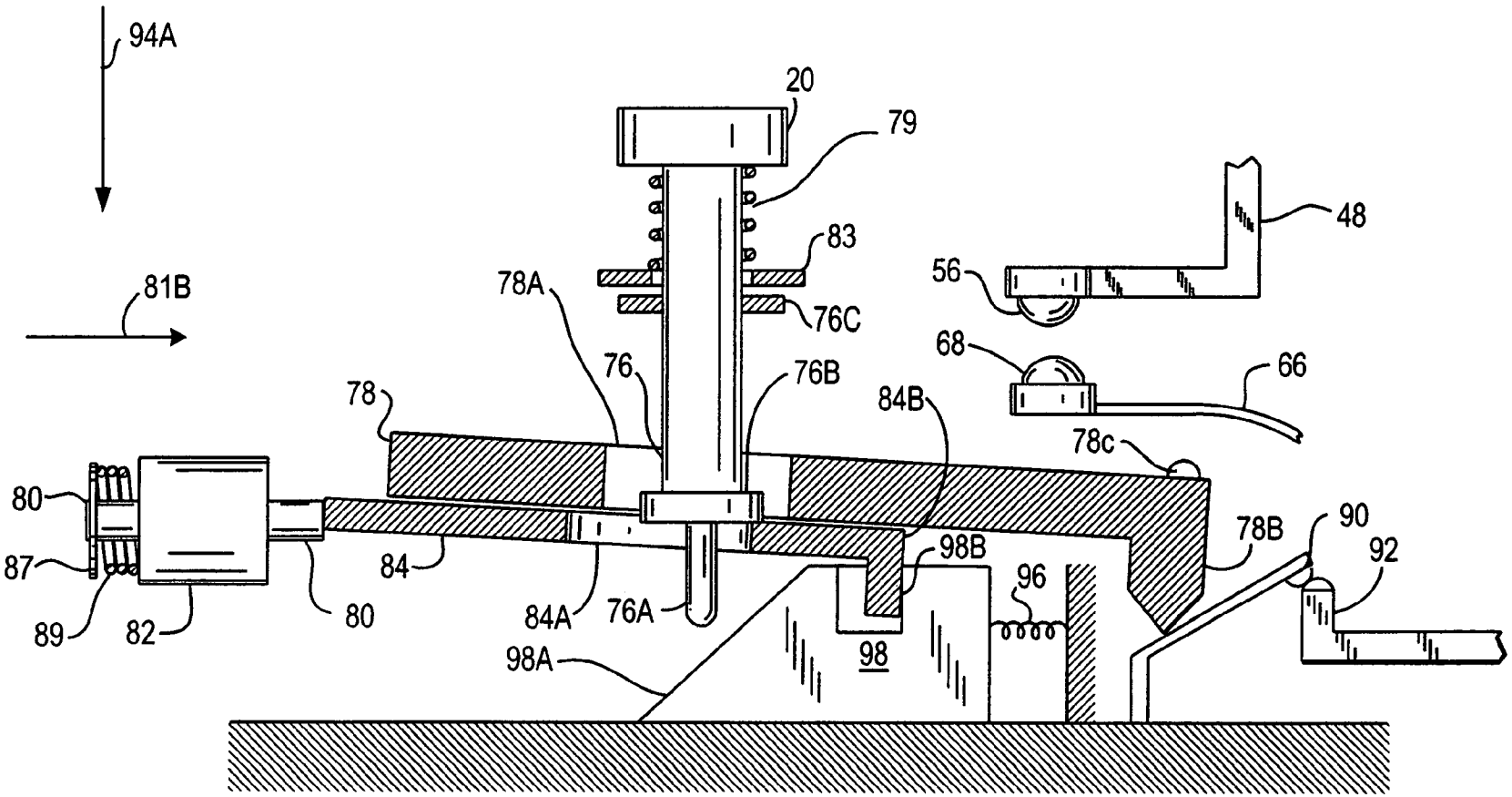

In FIG. 8, to initiate the resetting of the GFCI device, the test-reset button 20 is pressed downward (in the direction shown by 94A) causing flange 76B of the pin 76 to interfere with the latch plate 84. This downward force causes the latch protrusion 84B to move slightly downward within the actuator notch 98B. Because the latch plate 84 and the lifter 78 are bound together in the vertical direction, the downward movement of the latch 84 causes the lifter protrusion 78B to also move downward and the test arm 90 to make electrical contact with test pin 92. The electrical connection causes the coil 82 to be energized resulting in the plunger 80 to momentarily activate and engage latch plate 84 and, more specifically, to begin to push latch plate 84 in the direction shown by arrow 81B. As the latch plate 84 moves in the direction shown by arrow 81B, the latch protrusion 84B slides within the notch 98B in the same direction until the protrusion is in contact with the right side wall of the notch. As a result, the actuator 98 begins to slide in the direction shown by arrow 81B. As explained above, the width of the actuator notch 98B is larger than the width of the latch protrusion 84B. This provides a small time delay between the time the latch 84 begins to move in the direction 81B and the time when the actuator 98 follows. In particular, the latch 84 begins to move but the actuator 98 does not begin to move until the latch protrusion 84B contacts the right vertical wall of the actuator notch 98B at which time the actuator begins to move in the same direction as the latch.

Figure 9:
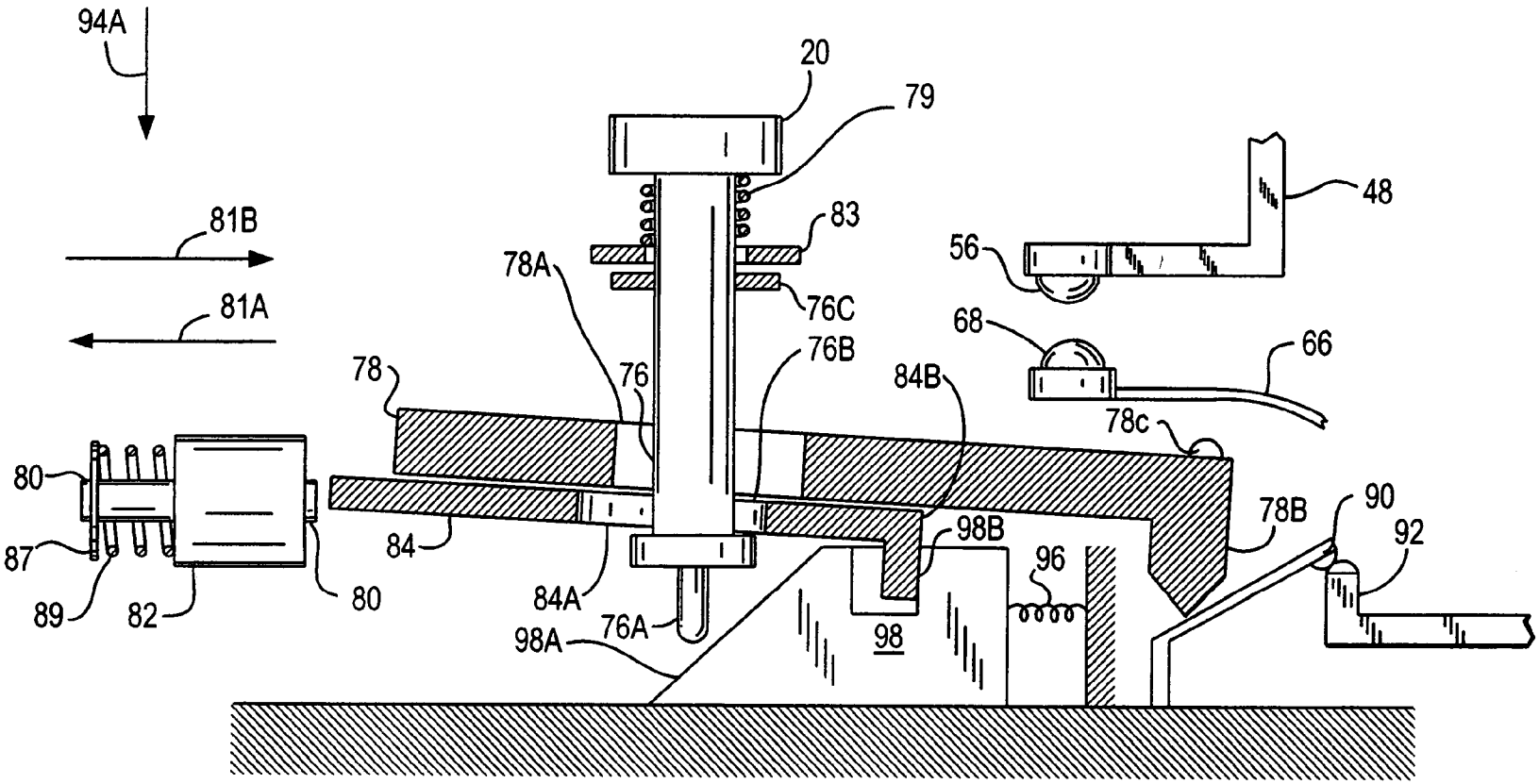

In FIG. 9, the movement of the actuator 98 compresses the actuator spring 96 and prevents interference between the cam portion 98A and the pin portion 76A. The latch plate 84, slides along lifter 78 (in the direction shown by arrow 81B) causing openings 84A and 78A to align and flange 76B and part of the pin portion 76A to extend downward through the openings in the direction shown by arrow 94A. Although the pin portion 76A extends downward through the openings, the pin portion does not make contact with the surface of the cam portion 98A. The plunger 80 recoils back into the coil 82 (in the direction shown by arrow 81A) because of the bias of coil spring 89.

Figure 10:
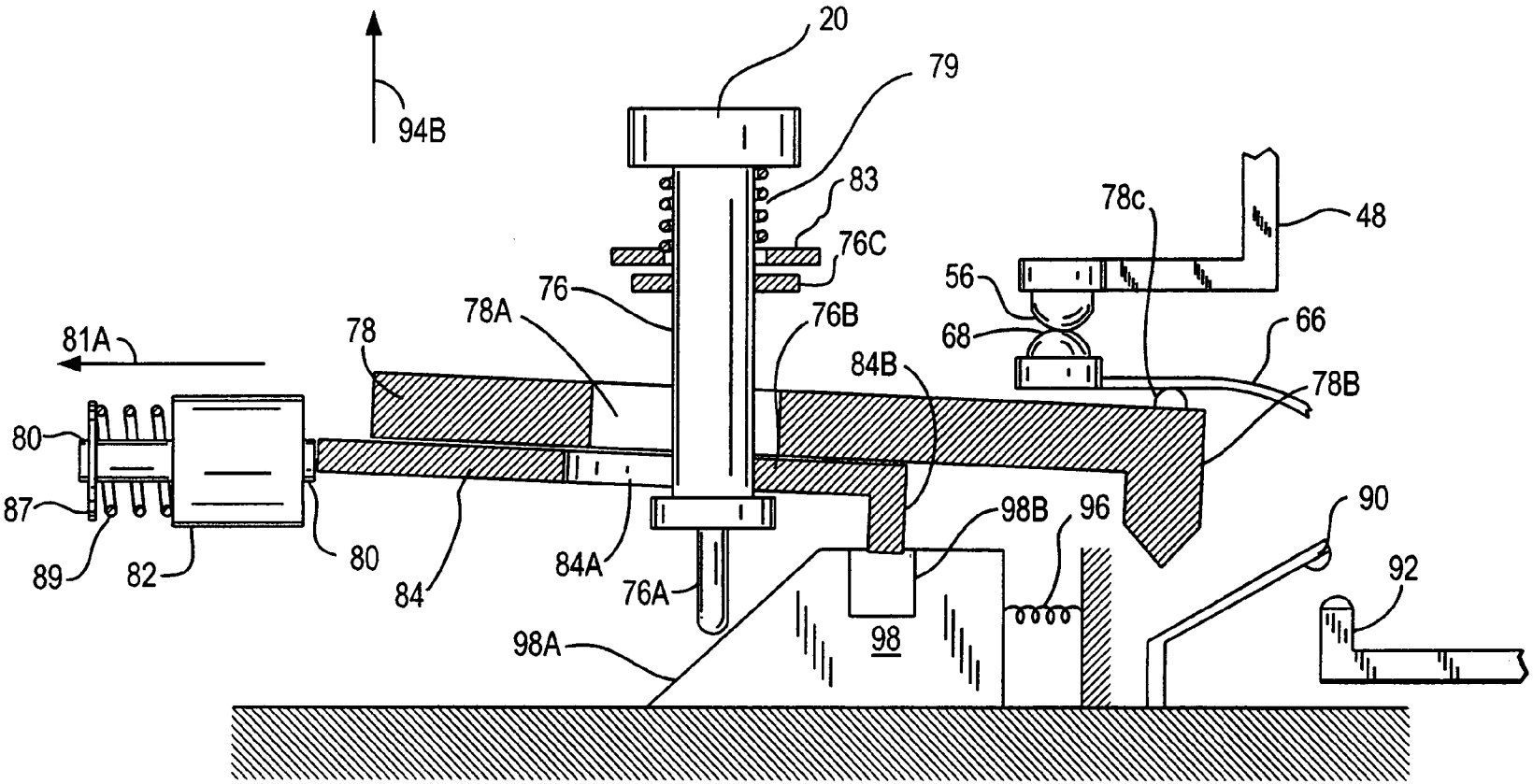

In FIG. 10, the recoil of the plunger 80 allows the latch plate 84 to recoil (in the direction shown by arrow 81A) because of the bias of the coil spring 96. The recoiling of the latch plate 84 causes the opening 84A to once again be misaligned with opening 78A thus trapping flange 76B underneath the lifter 78 and latch 84 assembly. The latch plate protrusion portion 84B remains engaged with trip actuator notch 98B. When the test-reset button 20 is released, the bias of the pin spring 79 in concert with the trapped flange 76B raise the lifter and latch assembly in the direction shown by arrow 94B. As a result of the upward movement, the lifter protrusion 78C applies an upward force (in the direction of arrow 94B) to the bottom side of the bridge 66 causing it to make electrical contact with contact 56 of frame 48. In a similar manner, contact 70 of bridge 66 (FIG. 3) becomes engaged with contact 58 of load terminal 54. In addition, contacts (72, 74) (FIG. 3) of bridge 64 become engaged with contact 62 of load terminal 54 and contact 60 of frame 46, respectively. As a result, line terminals, load terminals and face terminals become electrically connected to each other. The GFCI is now in the reset mode meaning that the electrical contacts of the line, load and face terminals are all electrically connected to each other allowing power from the line terminal to be provided to the load and face terminals. The GFCI will remain in the reset mode until the sensing circuit detects a fault or the GFCI is tripped purposely by depressing the test-reset button 20.

When the sensing circuit (FIG. 6) detects a condition such as a ground fault for a GFCI or other conditions (e.g., arc fault, immersion detection fault, appliance leakage fault, equipment leakage fault), the sensing circuit energizes the coil causing plunger 80 to engage the latch 84 resulting in the latch opening 84A being aligned with the lifter opening 78A allowing the pin portion 76A and flange 76B to escape from underneath the lifter causing the lifter to disengage from the movable bridges 64, 66 which, due to their biasing, move away from the face terminals contacts and load terminal contacts. As a result, the line, load and face terminals are electrically isolated from each other and thus the GFCI device is in a tripped state or condition (see FIG. 7).

Figure 11:
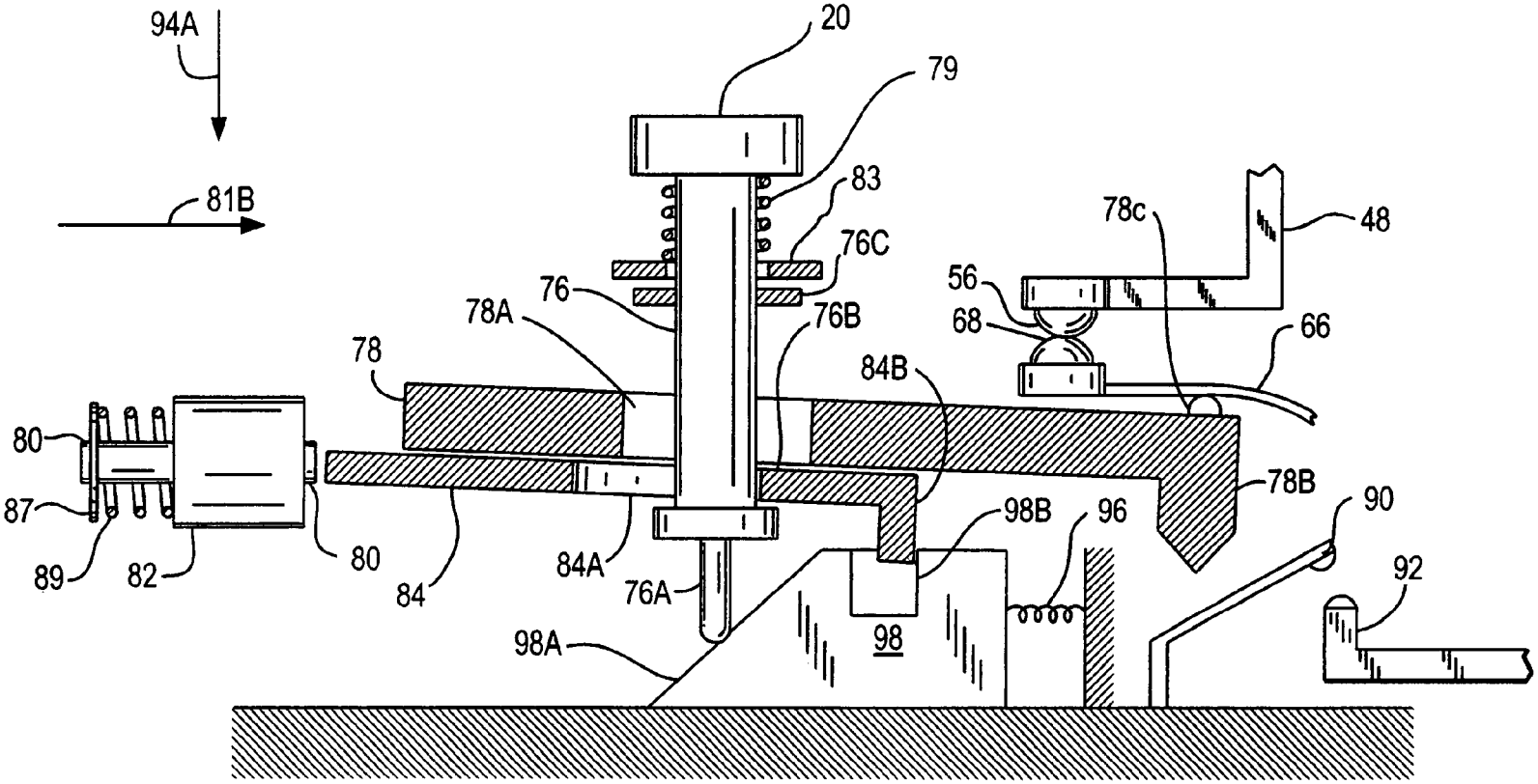
FIGS. 11-12 show the sequence of operation when the device of the present invention is tripped from a reset state.
Figure 12:
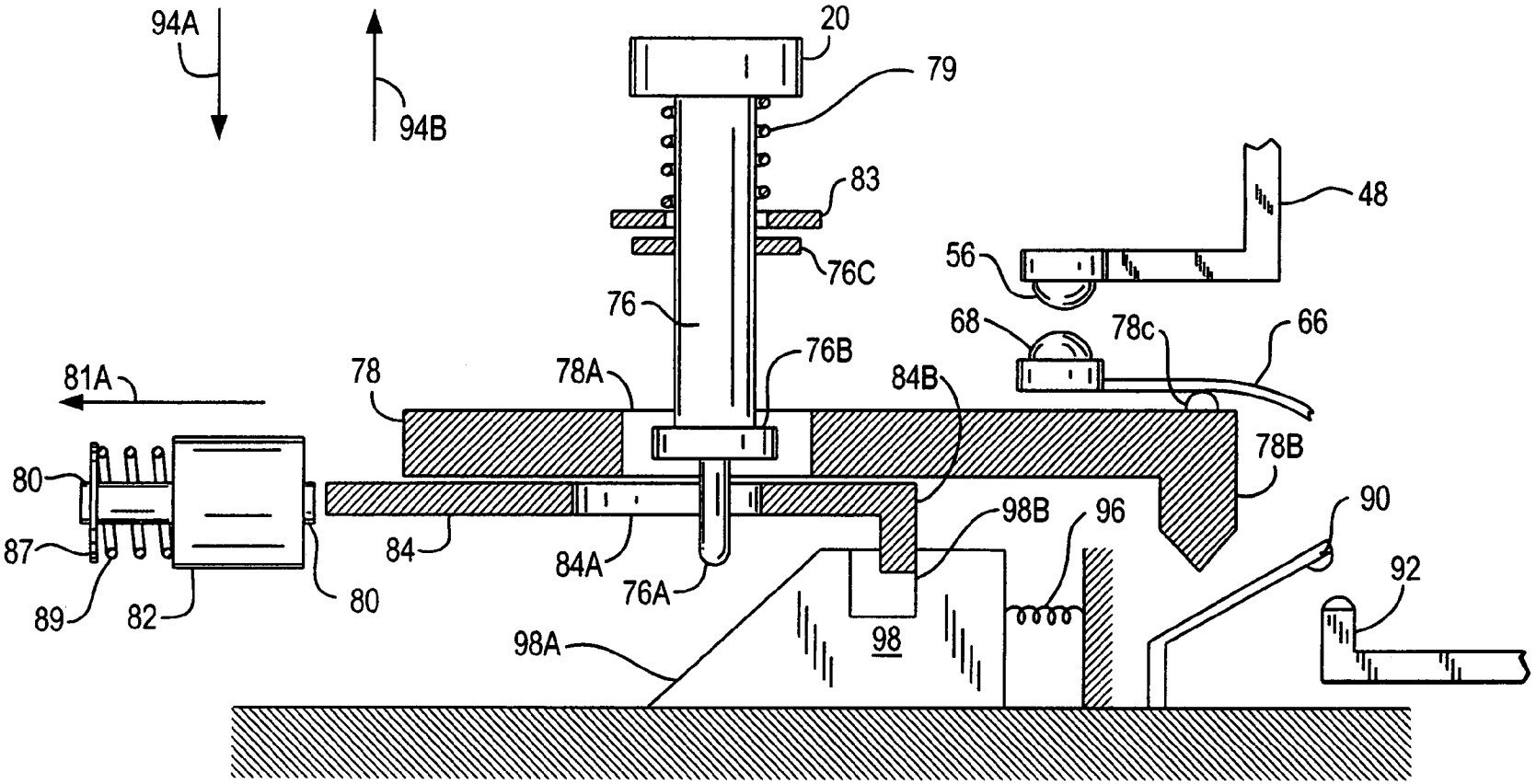

The GFCI device of the present invention can also enter the tripped state by pressing the test-reset button 20. In FIGS. 11-12, there is illustrated a sequence of operation showing how the device can be tripped. FIG. 11 shows the device in the reset state. In particular, contact 68 of bridge 66 is in contact with contact 56 of frame 48. Similarly, contact 70 of bridge 66 (FIG. 3) is in contact with contact 58 of load terminal 54. In addition, contacts (72, 74) (FIG. 3) of bridge 64 are in contact with contact 62 of load terminal 54 and contact 60 of frame 46, respectively. To initiate the tripping of the device, the test-reset button 20 is depressed in the downward direction as shown by arrow 94A. The mechanical trip actuator cam portion 98A preferably has a ramp shape so that when it engages with the pin portion 76A, a cam action occurs due to the angle of the cam portion. As the test-reset button 20 is pressed downward, the cam action causes the latch plate 84 to move and the actuator 98 to slide in the direction shown by arrow 81B. This movement causes the latch plate opening 84A to be aligned with lifter opening 78A as explained in detail below.

In FIG. 12, the alignment of the openings 78A, 84A allows the pin flange 76B to escape from underneath the latch plate 84 causing the pin 76 to raise upward (in the direction shown by 94B) due in part to the upward bias of the pin spring 79. Because the pin portion 76A is no longer making contact with the cam portion 98A, the actuator 98 begins to recoil in the direction 81A due in part to the bias of spring 96. As explained above, the width of the actuator notch 98B is larger than the width of the latch protrusion 84B. This feature provides a small time delay between the time the actuator 98 begins to recoil in the direction 81A and the time when the latch 84 follows. In particular, the actuator 98 begins to recoil but the latch plate 84 does not begin to move until the right vertical wall of the actuator notch 98B makes contact with the latch protrusion 84B at which time the latch begins to recoil in the same direction as the actuator. This time delay allows the pin 76 and the pin flange 76B sufficient time to escape from underneath the latch plate 84 before the latch plate moves and prevents the flange 76B from escaping from underneath the latch plate. Thus, the recoil action causes the latch plate opening 84A to be misaligned with the lifter opening 78A. As a result, the lifter 78 and protrusion 78C in concert with latch 84 move in the downward direction (arrow 94A) disengaging with the bottom side of the bridge 66 causing the contact 68 to also move downward and to disengage from contact 56 of frame 48. Similarly, contact 70 of bridge 66 (FIG. 3) becomes disengaged from contact 58 of load terminal 54. In addition, contacts (72, 74) (FIG. 3) of bridge 64 become disengaged from contact 62 of load terminal 54 and contact 60 of frame 46, respectively. As a result, the line, load and face terminals are electrically isolated from each other and thus the GFCI device is in a tripped state or condition. The device is now in the tripped position.

The GFCI device of the present invention once in the tripped position will not be allowed to be reset (by pushing the test-reset button) if the circuit interrupting portion is non-operational; that is if any one or more of the components of the circuit interrupting portion is not operating properly, the device cannot be reset. Further, if the sensing circuit is not operating properly, the device cannot be reset. The reset lockout mechanism of the present invention can be implemented in an affirmative manner where one or more components specifically designed for a reset lockout function are arranged so as to prevent the device from being reset if the circuit interrupting portion or if the sensing circuit are not operating properly. The reset lockout mechanism can also be implemented in a passive manner where the device will not enter the reset mode if any one or more of the components of the sensing circuit or if any one or more of the components of the circuit interrupting portion is not operating properly; this passive reset lockout approach is implemented in the present invention. For example, if anyone of the following components is not operating properly or has a malfunction—i.e., the coil/plunger assembly (82, 80) or the latch plate/lifter assembly (84, 78) or the test-reset button/pin (20, 76) or the mechanical trip actuator 98, spring assembly the device cannot be reset. Further if the test arm (90) or test pin (92) is not operating properly, the device cannot be reset.

The test-reset button can still trip the device in the event the circuit interrupting portion becomes non-operational because the button operates independently of the circuit interrupting portion. Preferably, the test-reset button is manually activated as discussed above (by pushing test-reset button) and uses mechanical components to break one or more conductive paths. However, the test-reset button may use electrical circuitry and/or electromechanical components to break either the phase or neutral conductive path or both paths.

Although the components used during circuit interrupting and device reset operations are electromechanical in nature, the present application also contemplates using electrical components, such as solid state switches and supporting circuitry, as well as other types of components capable of making and breaking electrical continuity in the conductive path.

It should also be noted that the circuit interrupting device of the present invention can be part of a system comprising one or more circuits routed through a house, for example, or through any other well known structure. Thus, the system of the present invention is configured with electricity conducting media (e.g., electrical wire for carrying electrical current) that form at least one circuit comprising at least one circuit interrupting device of the present invention, electrical devices, electrical systems and/or components; that is, electrical components, electrical devices and or systems can be interconnected with electrical wiring forming a circuit which also includes the circuit interrupting device of the present invention. The formed circuit is the system of the present invention to which electrical power is provided. The system of the present invention can thus protect its components, systems, or electrical devices by disconnecting them from power if the circuit interrupting device has detected a fault (or predetermined condition) from any one of them. In one embodiment, the circuit interrupting device used in the system can be a GFCI.

While there have been shown and described and pointed out the fundamental novel features of the invention as applied to the preferred embodiments, it will be understood that various omissions and substitutions and changes of the form and details of the method and apparatus illustrated and in the operation may be done by those skilled in the art, without departing from the spirit of the invention.

What is claimed is:

1. A ground fault circuit interrupter device comprising:

a circuit interrupter, positioned to engage a conductive path between line and load terminals and, upon the occurrence of a predetermined condition, break the conductive path placing the device in a tripped condition;

a reset system positioned to engage the conductive path to reestablish the conductive path between the line terminal and the load terminal placing the device in a reset condition;

a single actuator positioned to activate the circuit interrupter and the reset system, the circuit interrupter, when activated by the single actuator, causes a breaking of a conductive path between line and load terminals, and the reset system, when activated, causes the reestablishment of the conductive path between the line and load terminals; and a reset lockout mechanism, the reset lockout mechanism prevents the reestablishment of the conductive path between the line and load terminals if the circuit interrupter is non-operational.

2. A circuit interrupting device comprising:

a first electrical conductor;

a second electrical conductor;

a third electrical conductor, the first, second and third electrical conductors are electrically isolated from each other;

a movable bridge electrically connected to the first electrical conductor, said movable bridge positioned to electrically connect the first, second and third electrical conductors to each other or electrically disconnect the first, second and third electrical conductors from each other;

a circuit interrupter coupled to the movable bridge and upon the occurrence of a predetermined condition, the circuit interrupter engages the movable bridge to electrically disconnect the first second and third electrical conductors from each other;

a reset system coupled to the movable bridge; and a single actuator positioned to sequentially activate the circuit interrupter and the reset system, the circuit interrupter, when activated by the single actuator, causes the movable bridge to electrically disconnect the first, second and third electrical conductors from each other and the reset system, when activated, causes the movable bridge to electrically connect the first, second and third electrical conductors to each other.

3. The circuit interrupting device of claim 2 where the circuit interrupter comprises a coil and plunger assembly engageable with a latch plate which is engageable to a mechanical trip actuator assembly and slidably mounted to a lifter assembly, said lifter assembly is engageable with a mechanical switch assembly for activating a sensing circuit used to detect the predetermined condition.

4. The circuit interrupting device of claim 2 where the actuator comprises a button attached to a pin which has a flange portion extending from and integral with its end portion.

5. The circuit interrupting device of claim 2 where the predetermined condition comprises one of a ground fault, an arc fault, an appliance leakage fault, equipment leakage fault or an immersion detection fault.

6. The circuit interrupting device of claim 2 further comprising a sensing circuit for detecting the occurrence of a predetermined condition.

7. The circuit interrupting device of claim 2 where the movable bridge is an electricity conducting spring arm mechanically biased away from the second and third electrical conductors.

8. The circuit interrupting device of claim 2 where the first electrical conductor comprises a contact connected to electric conducting material at least part of which extends outside of a housing.

9. The circuit interrupting device of claim 2 where the second electrical conductor comprises a contact connected to electric conducting material at least part of which extends outside of a housing.

10. The circuit interrupting device of claim 2 further comprising a reset lockout mechanism that prevents the reestablishment of electrical continuity between said first, second and third conductors if the circuit interrupter is non-operational.

11. A method of tripping and resetting a ground fault circuit comprising having a single actuator, which when activated, and when the device is in the reset condition, activates a circuit interrupter of the device to break a conductive path between line and load terminals thereby placing the device in a tripped condition;

activating the same single actuator when the device is in the tripped condition, to activate a rest system of the device to reestablish a conductive path between the line and load terminals thereby placing the device in a reset condition; and preventing the reestablishment of the conductive path between the line and load terminals if the circuit interrupter is non-operational using a reset lockout.

12. The method of claim 11 where the circuit interrupter comprises a coil and plunger assembly, a latch plate and lifter assembly, a mechanical switch assembly and a mechanical trip actuator assembly for engaging a sensing circuit used to detect a predetermined fault condition.

13. The method of claim 11 where the actuator comprises a button attached to a pin which has a flange portion extending from and integral with its end portion.

14. The method of claim 11 further comprising detecting the occurrence of a predetermined condition using a sensing circuit.

15. A circuit interrupting device comprising:

a first electrical conductor;

a second electrical conductor;

a third electrical conductor, the first, second and third electrical conductors are electrically isolated from each other;

a movable bridge electrically connected to the first electrical conductor, said movable bridge positioned to electrically connect the first, second and third electrical conductors to each other or to electrically disconnect the first, second and third electrical conductors from each other; and a mechanism coupled to the movable bridge and comprising a single actuator, a reset system, and circuit interrupter, wherein the circuit interrupter activates the movable bridge to cause electrical discontinuity between the first, second and third electrical conductors, and the reset system activates the movable bridge to reestablish electrical continuity between the first, second and third electrical conductors, and wherein the single actuator sequentially activates the circuit interrupter and the reset system.

16. The circuit interrupting device of claim 15 where the circuit interrupter comprises a coil and plunger assembly engageable with a latch plate which is engageable to a mechanical trip actuator assembly and slidably mounted to a lifter assembly, said lifter assembly is engageable with a mechanical switch assembly for activating a sensing circuit used to detect the predetermined condition.

17. The circuit interrupting device of claim 16 where the predetermined condition comprises a ground fault, an arc fault, an appliance leakage fault, equipment leakage fault or an immersion detection fault.

18. The circuit interrupting device of claim 15 further comprising a sensing circuit for detecting the occurrence of a predetermined condition.

19. The circuit interrupting device of claim 15 where the movable bridge is an electricity conducting spring arm mechanically biased away from the second and third electrical conductors.

20. The circuit interrupting device of claim 15 where the first electrical conductor comprises a contact connected to electric conducting material at least part of which extends outside a housing.

21. The circuit interrupting device of claim 15 where the second electrical conductor comprises a contact connected to electric conducting material at least part of which extends outside a housing.

22. The circuit interrupting device of claim 15, further comprising a reset lockout mechanism that prevents the reestablishment of electrical continuity between said first, second and third conductors if the circuit interrupting portion is non-operational.

23. A GFCI device comprising:

a housing;

a pair of line terminals disposed at least partially within said housing and capable of being electrically connected to a source of electricity;

a pair of load terminals disposed at least partially within said housing and capable of conducting electrical current to a load when electrically connected to said line terminals;

a pair of movable bridges each having two fingers and a bent portion where each end of the bent portions is connected to a line terminal, said two fingers of each of the movable bridges are mechanically biased away from the line and load terminals and said two fingers are capable of electrically connecting the line, load and face terminals to each other; and a mechanism for initiating electrical continuity and electrical discontinuity, wherein the mechanism comprises a single actuator, a reset system, and circuit interrupter, wherein the circuit interrupter causes electrical discontinuity by engaging the movable bridges to break a connection between the line terminals, the load and face terminals, wherein the reset system reestablishes electrical continuity by engaging the movable bridges to reconnect the line terminals to the load and face terminals, and wherein the single actuator sequentially activates the circuit interrupter and the reset system.

24. The GFCI device of claim 23 where the pair of line terminals are metallic conductors with binding screws attached thereto where such binding screws are at least partially located outside of the housing.

25. The GFCI device of claim 23 where the pair of load terminals are metallic conductors with binding screws attached thereto where such binding screws are at least partially located outside of the housing.

26. The GFCI device of claim 23 where the user accessible receptacles are configured to receive an outlet plug.

27. The GFCI device of claim 23 where each movable bridge of the pair of movable bridges is a metallic strip having a connecting portion and a bent end portion, where the connecting portion comprises two fingers with each finger having a contact attached thereto for engaging corresponding face and load contacts and the connecting portion is mechanically biased away from the face and load terminals.

28. The GFCI device of claim 23 further comprising a reset lockout mechanism that prevents the reestablishment of electrical continuity between the line, load and face terminals if the circuit interrupter is non-operational.

* * * * *